US008870128B1

(12) United States Patent
Voelkerding et al.

(10) Patent No.: US 8,870,128 B1
(45) Date of Patent: Oct. 28, 2014

(54) FLANGE BEARING FROG CROSSING

(75) Inventors: Daniel Voelkerding, Cleveland, OH (US); James A. Remington, Sheffield Village, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 222 days.

(21) Appl. No.: 13/617,311

(22) Filed: Sep. 14, 2012

Related U.S. Application Data

(60) Provisional application No. 61/534,616, filed on Sep. 14, 2011.

(51) Int. Cl.
*E01B 7/10* (2006.01)
*E01B 7/12* (2006.01)

(52) U.S. Cl.
CPC ..... *E01B 7/12* (2013.01)
USPC ..... 246/468; 246/274; 246/382

(58) Field of Classification Search
USPC ..... 246/274, 275, 382–392, 468–471
See application file for complete search history.

(56) References Cited

U.S. PATENT DOCUMENTS

| | | | | | |
|---|---|---|---|---|---|
| 4,982,919 | A * | 1/1991 | Durchschlag et al. | ..... | 246/382 |
| 5,544,848 | A * | 8/1996 | Kuhn et al. | ..... | 246/276 |
| 5,560,571 | A * | 10/1996 | Remington | ..... | 246/468 |
| 5,595,361 | A * | 1/1997 | Remington et al. | ..... | 246/276 |
| 5,746,400 | A * | 5/1998 | Remington et al. | ..... | 246/465 |
| 5,845,881 | A * | 12/1998 | Young et al. | ..... | 246/457 |
| 6,138,958 | A * | 10/2000 | Irie et al. | ..... | 246/276 |
| 6,164,602 | A * | 12/2000 | Kuhn et al. | ..... | 246/382 |
| 6,224,023 | B1 * | 5/2001 | Young et al. | ..... | 246/454 |
| 6,276,642 | B1 * | 8/2001 | Young et al. | ..... | 246/276 |
| 6,286,791 | B1 * | 9/2001 | Young et al. | ..... | 246/382 |
| 6,732,980 | B2 * | 5/2004 | Hein | ..... | 246/455 |
| 6,994,299 | B2 * | 2/2006 | Marron | ..... | 246/382 |
| 7,083,149 | B2 * | 8/2006 | Heinze et al. | ..... | 246/472 |
| 7,121,513 | B2 * | 10/2006 | Leitner | ..... | 246/468 |
| 7,377,471 | B1 * | 5/2008 | Compton et al. | ..... | 246/391 |
| 8,424,812 | B1 * | 4/2013 | Voelkerding et al. | ..... | 246/468 |
| 8,424,813 | B1 * | 4/2013 | Voelkerding et al. | ..... | 246/468 |
| 2004/0065784 | A1 * | 4/2004 | Hein | ..... | 246/468 |
| 2004/0124316 | A1 * | 7/2004 | Marron | ..... | 246/454 |
| 2005/0067535 | A1 * | 3/2005 | Leitner | ..... | 246/468 |
| 2005/0145754 | A1 * | 7/2005 | Heinze et al. | ..... | 246/468 |
| 2007/0001060 | A1 * | 1/2007 | Mugg | ..... | 246/385 |
| 2007/0007394 | A1 * | 1/2007 | Hein et al. | ..... | 246/382 |
| 2010/0270436 | A1 * | 10/2010 | Wientges et al. | ..... | 246/407 |
| 2014/0034788 | A1 * | 2/2014 | Voelkerding et al. | ..... | 246/465 |

* cited by examiner

*Primary Examiner* — Jason C Smith
(74) *Attorney, Agent, or Firm* — Roger A. Gilcrest

(57) ABSTRACT

The invention may be described as including a crossing panel assembly for a railway intersection, as well as a rail intersection design and a frog casting therefor. The present invention may be used for single and multiple crossings as will be appreciated from the description and drawings. The invention may be described as including a crossing panel assembly for a railway intersection, as well as a rail intersection design and a frog casting therefor. The present invention may be characterized as a frog containing panel system assembled with an array of castings that form a full flange bearing crossing to provide a rail intersection.

11 Claims, 52 Drawing Sheets

FLANGE BEARING FROG CROSSING

RELATED APPLICATION DATA

This application claims the priority benefit of U.S. Provisional Application Ser. No. 61/534,616, filed Sep. 14, 2011, which is hereby incorporated in its entirety herein by reference.

FIELD OF THE INVENTION

The present invention relates to a railroad track and crossing assemblies.

BACKGROUND OF THE INVENTION

The present invention relates to a crossing assembly for a railway crossing panel. A railway crossing is employed where one track crosses another.

Typically, railroad crossing components are some of the highest maintenance portions of a railroad track arrangement as they must endure repetitive impact and stress.

In prior art arrangement, relatively large frog castings are used to lift the wheels to a height necessary to allow the wheels of a train to cross a main line rail. When the wheels cross the gap they generate impacts that adversely affect the frog, wheels, and the track structure. Although each of the foregoing designs is workable, an improved design that further reduces the railroad maintenance would be desirable.

In providing for rail crossing, it is important to accommodate several aspects relating to the main line running and the crossing rail line.

In order to allow the train car wheel set to cross over a main line rail, it must be raised to a height to allow it to cross the near main running rail, maintained securely at that height to cross the far main running rail and then securely returned to the base running height along the rail course and without causing excessive repetitive bounce typically experienced in prior crossing arrangements.

Typically this is accomplished by using a frog casting disposed between and on either side of the main line rails. These castings are designed to lift the wheel, direct it through the transition zone over both main line rails, and capture the wheel, allowing it to relax to the established rail elevation. For these purposes, the dual frogs are specially cast and custom machined to provide the required shaping, such as that to provide the required ramping and channeling for support and capture of the wheel tread and flange, to be able to firmly and accurately provide mechanical action under high strain and impact conditions.

It is advantageous to be able to provide this mechanical action with reduced expense and effort associated with the production of relatively expensive multiple castings that require custom machining that are customary in the industry. In this regard, frog castings typically incorporate ramping in the design of the main body casting that require rather complex post-casting machining, and it is beneficial to reduce or eliminate complex ramping within the body of the casting.

It is also best to provide a uniform, unbroken wheel path that distributes load and reduces wheel and frog wear, such as may be accomplished by providing a horizontal or otherwise linearly regular wheel path that is not interrupted by wheel-to-rail interface.

Typically frog casting systems must incorporate all of the required ramping with the length of the casting, which requires relatively larger castings to distribute the ramping length to reduce inertial bounce as the wheel sets pass over the main line rail. This makes typical frog casting systems relatively large and expensive. Accordingly, it would be beneficial to reduce the overall casting size, and thereby reduce the initial cost of frog production while at the same time reducing the cost of attendant repair and maintenance.

One type of frog casting used for crossings is the so-called full flange bearing frog that operates by engaging the flange of each of the wheels in a wheel set and raising the wheel set as the wheels ride on their flanges (rather than on their treads) to a crossing height, and are maintained at that height. This type of system offers several advantages such as the use of the wheel flanges as the weight-bearing portion of the wheel, which are not subject to as much reduction in outer diameter as the tread bearing surface over the lifetime of the wheel, thus presenting a more regular bearing surface to the casting.

One of the problems associated with full flange bearing frog castings is that they must be incorporated into a system where all or substantially all of the crossing is constructed of interlocking castings such that they form intersecting continuous flange ways. Accordingly, these castings are relatively large and expensive as compared to crossing systems that incorporate rails or other tread bearing structures.

In addition, full flange bearing frog castings must endure very high stress and impact, reducing their lifetime. Because the replacement costs of such large castings are very high, it is desirable to provide a casting and overall panel set-up that accommodates long-term wear while lowering overall costs of use in terms of lengthening the operational lifetime of the casting within the panel.

It is also beneficial to provide a crossing system that may be made and installed simply, while also being adapted for prefabrication and installation, and one that is relatively easy to assemble and repair. In this regard, it is desirable to eliminate multiple castings, make their production easier and less expensive, and provide frog panels that are adapted to reduce overall track and crossing wear associated with long term use, and that accommodate changes in wheel geometry as wheel degradation occurs over the wheel's operational life cycle.

The embodiments of the invention described herein address the shortcomings of the prior art.

SUMMARY OF THE INVENTION

In general terms, the invention may be described as including a crossing panel assembly for a railway intersection, as well as a rail intersection design and a frog casting therefor.

The present invention may be used for single and multiple crossings as will be appreciated from the description and drawings.

The present invention may be characterized as a frog containing panel system, and the frog and rail intersection used therein.

The present invention thus provides several concomitant advantages over the prior art. The system of the present invention allows the required ramping for the approaching wheel set to be presented by the flange way floor while also allowing a substantial portion of the run of the tread-bearing surface of the approaching wheel to be borne by the associated rail, rather than by the corresponding upper surface (i.e., the tread-bearing surface) of the frog casting. In addition, the castings and their arrangement allow the tread-bearing surface of the approaching wheel to be borne by the tread-bearing surface of the associated rail along a substantial portion of the run-up distance such that, as the flange way floor wears over time, the tread-bearing surface of the associated rail astride the worn section will continue to provide tread-borne support for the wheel as it must travel deeper into the flange way until the wheel flange is encountered by a relatively more downstream portion of the flange way floor.

The present invention also includes a crossing panel system which may be assembled as a complete unit at a manufacturing site and transported to its intended installation site. This allows for greater control of manufacturing costs and allows the operator to obtain a completed crossing panel that may be produced using relatively small and simple frog castings that can be installed on site, and castings that can be assembled into a fully flange-bearing crossing arrangement.

In operation, the system of the present invention also provides for an unbroken wheel path that is substantially a horizontal or otherwise linearly regular wheel path and that is not interrupted by wheel to rail interface. Rather, it accepts and allows the wheel set to move through the respective intersecting main line or crossing line flange ways. In this same regard, it will be understood that reference to main line and crossing line, or first line and second line, may be somewhat redundant as the subject crossing arrangement does not feature a classic pass-over main line and crossing line arrangement as in typical tread-bearing crossings.

Rail crossing systems of the present invention may be incorporated with canted rail systems that allow for speeds as high as 50-60 mph where desirable.

The several aspects of the present invention may be summarized as follows.

In general terms the present invention includes castings and a panel arrangement, as well as a crossing constructed thereby.

Full Flange Bearing Rail Crossing Frog and Single Rail Arrangement

In general terms, the invention includes a full flange bearing rail crossing frog and rail arrangement comprising: (a) a frog casting comprising: (i) a main line body portion having a top surface and comprising a main line flange way having: (1) a main line flange way floor, and (2) opposed main line flange way lateral wall portions; (ii) a crossing line body portion having a top surface and comprising a crossing line flange way having: (1) an intersection portion of the crossing line flange way having: (a) a crossing line flange way floor; (b) a crossing line internal lateral wall portion; and (c) a crossing line external lateral wall portion; and (2) a lead portion of the crossing line flange way having: (a) a crossing line flange way floor; (b) a crossing line internal lateral wall portion; and (c) an open crossing line external lateral side; the main line flange way and the crossing line flange way forming an intersection at an intersection level; and a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface.

The frog casting preferably comprises a first section comprising the main line body portion and the intersection portion of the crossing line flange way, and a second section comprising the lead portion of the crossing line flange way.

The crossing line flange way floor of the lead portion of the crossing line flange way is angled so as to raise the flange of a rail car wheel rolling therethrough from a lower level to a higher level of that of the intersection portion of crossing line flange way.

The present invention may also be considered to include a full flange bearing rail crossing frog and rail arrangement comprising: (a) a frog casting comprising: (i) a main line body portion having a top surface and comprising a main line flange way having a main line flange way floor and opposed main line flange way lateral wall portions; and (ii) a crossing line body portion having a top surface and comprising a crossing line flange way, the crossing line flange way comprising: (1) a crossing line flange way floor and (2) a crossing line internal lateral wall portion; and (3) an open crossing line external lateral side; and wherein the main line flange way and the crossing line flange way forming an intersection at an intersection level; and (b) a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface. It is preferred that the crossing rail has a terminal end abutting the crossing line tread bearing portion at an angle in the range of from about 50 degrees to about 70 degrees from the crossing line flange way floor.

The crossing line flange way floor typically has an inclined portion adapted to raise the flange of a wheel approaching the frog casting from the crossing rail to the intersection level. The rise and run will be determined based upon the desired load and operating speeds, and typically will be in the range of from about 50 degrees to about 70 degrees from the horizontal.

It is also preferred that the open crossing line external lateral side be open through a substantial portion of the overall running length of the flange way from the initially encountered (i.e., distal) end to the intersection point. Preferably, the open-sided external lateral side will represent at least 50 percent, preferably between 60 and 90 percent, and most preferably between 75 and 85 percent of the overall flange way distance.

The frog casting may be manufactured as a single casting, but preferably, owing to manufacturing efficiencies, may be made and assembled from more than one casting, such as in the preferred embodiment which includes a central intersection portion and an extension portion.

Full Flange Bearing Rail Crossing Frog and Single Crossing Rail and Single Main Rail Arrangement The present invention may also be understood as including a full flange bearing rail crossing frog with a single crossing rail and single main rail arrangement. This aspect of the invention may be described as a full flange bearing rail crossing frog and rail arrangement comprising: (a) a frog casting comprising: (i) a main line body portion having a main line top surface and a main line flange way, the main line flange way comprising: (1) a main line flange way floor and (2) a main line internal lateral wall portion; and (3) a main line open external lateral side; and (ii) a crossing line body portion having a crossing line top surface and a crossing line flange way, the crossing line flange way comprising: (1) a crossing line flange way floor and (2) a crossing line internal lateral wall portion; and (3) a crossing line open external lateral side; the main line flange way floor and the crossing line flange way floor forming an intersection at an intersection level; and (b) a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface; and (c) a main rail having a main rail tread bearing surface, the main rail disposed along the open main line external lateral side, and adjacent the main line body portion top surface, such that the main rail tread bearing surface is vertically aligned with the main line body portion top surface.

It is preferred that the crossing rail has a terminal end abutting the crossing line tread bearing portion at an angle in the range of from about 50 degrees to about 70 degrees from the crossing line flange way floor, and likewise that the main rail has a terminal end abutting the main line tread bearing portion at an angle in the range of from about 50 degrees to about 70 degrees from the main line flange way floor.

It is preferred that the crossing line flange way floor has an inclined portion adapted to raise the flange of a wheel approaching the frog casting from the crossing rail to the intersection level, and likewise that the main line flange way floor has an inclined portion adapted to raise the flange of a wheel approaching the frog casting from the main rail to the intersection level.

Both the crossing line flange way floor and the main line flange way floor typically have an inclined portion adapted to raise the flange of a wheel approaching the frog casting from the crossing rail to the intersection level. The rise and run will be determined based upon the desired load and operating speeds, and typically will be in the range of from about 1 to 3 inches in about 4-6 feet, from the horizontal, preferably about 1.5 inches in about 4 feet.

It is also preferred that the open crossing and main line external lateral sides be open through a substantial portion of the respective overall running length of the flange way from the initially encountered (i.e., distal) end to the intersection point. Preferably, the open-sided external lateral side will represent at least 50 percent, preferably between 60 and 90 percent, and most preferably between 75 and 85 percent of the overall flange way distance.

The frog casting may be manufactured as a single casting, but preferably, owing to manufacturing efficiencies, may be made and assembled from more than one casting, such as in the preferred embodiment which includes a central intersection portion and two respective crossing line extension portions.

Full Flange Bearing Rail Crossing Frog and Rail Intersection Arrangement—Two Main Rails and Two Crossing Rails The present invention may also be understood as including a full flange bearing rail crossing frog and rail intersection arrangement with both two main rails and two crossing rails. This construction of the invention may be described in general terms as a full flange bearing rail crossing frog and rail arrangement comprising: (a) a first frog casting comprising: (i) a main line body portion having a main line top surface and a main line flange way, the main line flange way comprising: (1) a main line flange way floor and (2) a main line internal lateral wall portion; and (3) a main line open external lateral side; and (ii) a crossing line body portion having a crossing line top surface and a crossing line flange way, the crossing line flange way comprising: (1) a crossing line flange way floor and (2) a crossing line internal lateral wall portion; and (3) a crossing line open external lateral side; the main line flange way floor and the crossing line flange way floor forming an intersection at an intersection level; and (b) a first crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface; and (c) a first main rail having a main rail tread bearing surface, the main rail disposed along the open main line external lateral side, and adjacent the main line body portion top surface, such that the main rail tread bearing surface is vertically aligned with the main line body portion top surface; (d) a second frog casting comprising: (i) a main line body portion having a main line top surface and a main line flange way, the main line flange way comprising: (1) a main line flange way floor and (2) a main line internal lateral wall portion; and (3) a main line open external lateral side; and (ii) a crossing line body portion having a crossing line top surface and a crossing line flange way, the crossing line flange way comprising: (1) a crossing line flange way floor and (2) a crossing line internal lateral wall portion; and (3) a crossing line open external lateral side; the main line flange way floor and the crossing line flange way floor forming an intersection at an intersection level; and (e) a second crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface; and (f) a second main rail having a main rail tread bearing surface, the main rail disposed along the open main line external lateral side, and adjacent the main line body portion top surface, such that the main rail tread bearing surface is vertically aligned with the main line body portion top surface, the first frog casting and the second frog casting arranged so as to form a continuous main line flange way floor and continuous crossing line flange way floor.

It is preferred that the crossing rail has a terminal end abutting the crossing line tread bearing portion at an angle in the range of from about 50 degrees to about 70 degrees from the crossing line flange way floor, and likewise that the main rail has a terminal end abutting the main line tread bearing portion at an angle in the range of from about 50 degrees to about 70 degrees from the main line flange way floor.

It is preferred that the crossing line flange way floor has an inclined portion adapted to raise the flange of a wheel approaching the frog casting from the crossing rail to the intersection level, and likewise that the main line flange way floor has an inclined portion adapted to raise the flange of a wheel approaching the frog casting from the main rail to the intersection level.

Both the crossing line flange way floor and the main line flange way floor typically have an inclined portion adapted to raise the flange of a wheel approaching the frog casting from the crossing rail to the intersection level. The rise and run will be determined based upon the desired load and operating speeds, and typically will be in the range of from about 1 to 3 inches in about 4-6 feet, from the horizontal, preferably about 1.5 inches in about 4 feet.

It is also preferred that the open crossing and main line external lateral sides be open through a substantial portion of the respective overall running length of the flange way from the initially encountered (i.e., distal) end to the intersection point. Preferably, the open-sided external lateral side will represent at least 50 percent, preferably between 60 and 90 percent, and most preferably between 75 and 85 percent of the overall flange way distance.

The frog casting may be manufactured as a single casting, but preferably, owing to manufacturing efficiencies, may be made and assembled from more than one casting, such as in the preferred embodiment which includes a central intersection portion and two respective crossing line extension portions.

Full Flange Bearing Rail Crossing Frog Arrangement

Still another aspect of the present invention is a full flange bearing rail crossing frog casting arrangement comprising a planar arrangement of four adjacent frog castings, each frog casting comprising: (i) a main line body portion having a main line top surface and a main line flange way, the main line flange way comprising: (1) a main line flange way floor and (2) a main line internal lateral wall portion; and (3) a main line open external lateral side; and (ii) a crossing line body portion having a crossing line top surface and a crossing line flange way, the crossing line flange way comprising: (1) a crossing line flange way floor and (2) a crossing line internal lateral wall portion; and (3) a crossing line open external lateral side; the main line flange way floor and the crossing line flange way floor forming an intersection at an intersection level; and wherein each frog casting arranged such that respective adjacent main line flange way floors are aligned and adjacent crossing line flange way floors are aligned.

A full flange bearing rail crossing frog casting arrangement comprising a planar arrangement of four adjacent frog castings, each frog casting comprising: (i) a main line body portion having a top surface and comprising a main line flange way having: (1) a main line flange way floor, and (2) opposed main line flange way lateral wall portions; (ii) a crossing line body portion having a top surface and comprising a crossing line flange way having: (1) an intersection portion of the crossing line flange way having: (a) a crossing line flange way floor; (b) a crossing line internal lateral wall portion; and (c) a crossing line external lateral wall portion; and (2) a lead portion of the crossing line flange way having: (a) a crossing line flange way floor; (b) a crossing line internal lateral wall portion; and (c) an open crossing line external lateral side; the main line flange way floor and the crossing line flange way floor forming an intersection at an intersection level; and wherein each frog casting arranged such that respective adjacent main line flange way floors are aligned and adjacent crossing line flange way floors are aligned.

In a preferred embodiment, the frog casting comprises a first section comprising the main line body portion and the intersection portion of the crossing line flange way, and a second section comprising the lead portion of the crossing line flange way.

Each crossing line flange way floor of the lead portion of each respective crossing line flange way is angled so as to raise the flange of a rail car wheel rolling therethrough from a lower level to a higher level of that of the intersection portion of crossing line flange way. Likewise, it is preferred that each crossing line flange way floor has an inclined portion adapted to raise the flange of a wheel approaching the frog casting from the crossing rail to the intersection level.

It is also preferred that each casting has a crossing rail abutting surface at an angle in the range of from about 50 degrees to about 70 degrees from the crossing line flange way floor, and that each casting has a main rail abutting surface at an angle in the range of from about 50 degrees to about 70 degrees from the main line flange way floor.

Preferably each main line flange way floor has an inclined portion adapted to raise the flange of a wheel approaching the frog casting from the main rail to the intersection level.

It will be understood that all disclosed features of the present invention may be utilized to the extent that they are not logically inconsistent with one another.

DETAILED DESCRIPTION OF THE PREFERRED EMBODIMENTS

Figure 1:
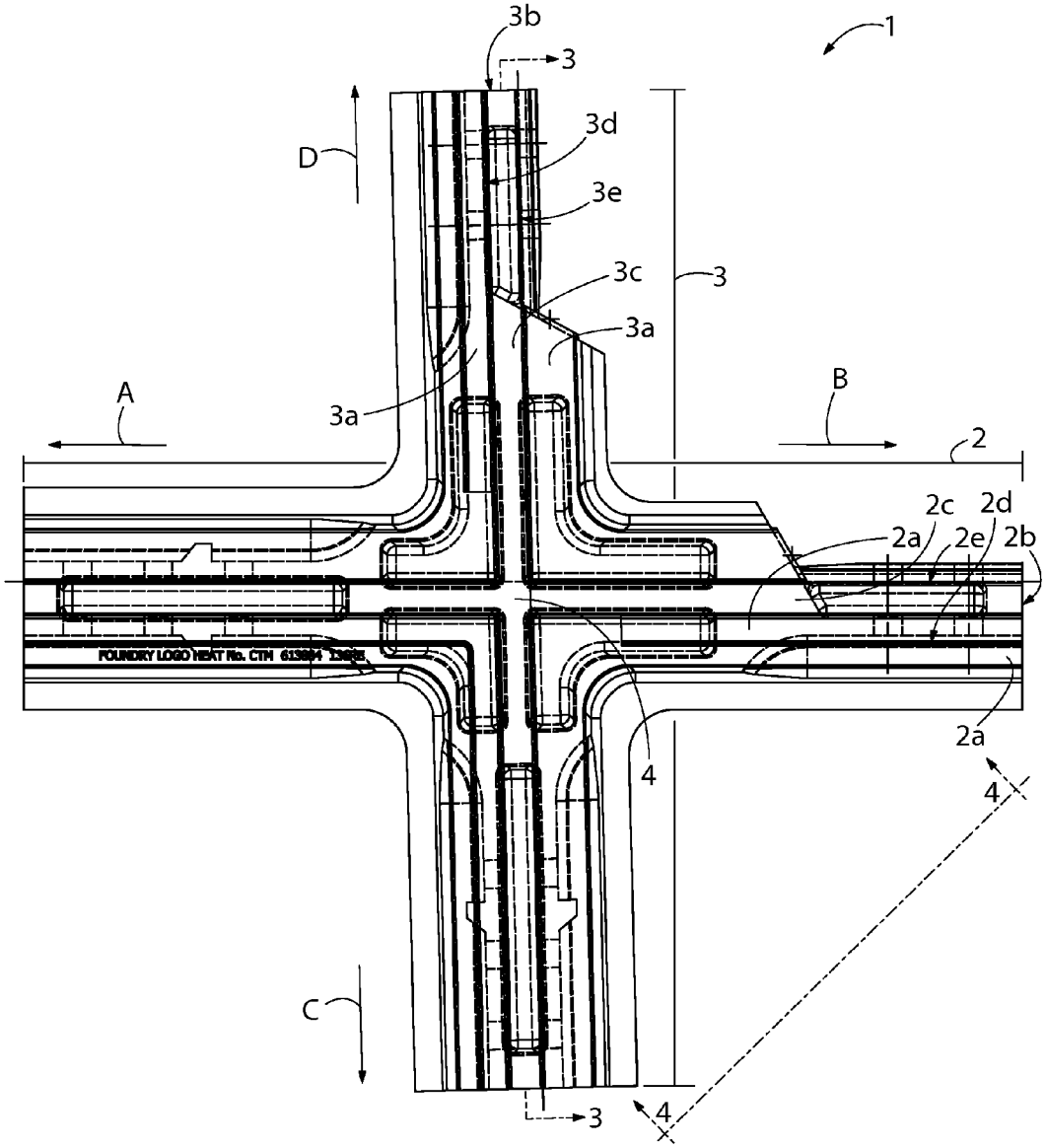
FIG. 1 is a plan view of a center frog casting in accordance with one embodiment of the present invention.

In accordance with the foregoing summary, the following describes a preferred embodiment of the present invention which is considered to be the best mode thereof. With reference to the drawings, the invention will now be described in detail with regard for the best mode and preferred embodiment.

FIGS. 1-23 show, using like reference numerals, a full flange bearing rail crossing frog casting and crossing assembly, in accordance with one embodiment of the present invention.

FIG. 1 shows a plan view of a center full flange bearing rail crossing frog casting 1 in accordance with the preferred embodiment of the present invention.

This frog will be part of a full flange bearing rail crossing frog casting arrangement of the present invention as described herein and comprising a planar arrangement of four adjacent frog castings.

The center crossing frog casting 1 comprises a crossing line body portion 2 (that will extend within the main line way, in direction A, and outside the main line way, in direction B, once the arrangement is assembled), having a crossing line top surface 2*a* and a crossing line flange way 2*b*, the crossing line flange way comprising: (1) a crossing line flange way floor 2*c* and (2) a crossing line internal lateral wall portion 2*d*; and (3) a crossing line open external lateral side 2*e*.

The center crossing frog casting 1 also comprises a main line body portion 3 (that will extend within the crossing line way, in direction C, and outside the crossing line way, in direction D, once the arrangement is assembled) having a main line top surface 3*a* and a main line flange way 3*b*, the main line flange way comprising: (1) a main line flange way floor 3*c* and (2) a main line internal lateral wall portion 3*d*; and (3) a main line open external lateral side 3*e*.

The crossing line flange way floor 2*c* and the main line flange way floor 3*c* form an intersection 4 at an intersection level.

The center crossing frog casting 1 is adapted to be provided with spaces alongside crossing line open external lateral side 2*e* and the main line open external lateral side 3*e* that accommodate the placement of a respective rail such that such respective rail may be placed astride the respective flange way floors, so as to form an external lateral flange way wall opposite the corresponding internal lateral wall portion. FIG. 1 also shows the respective casting faces 2*f* and 3*f* that conform to the corresponding shape of the terminal end of the rail may be placed astride the respective flange way floors. This angle is typically an angle in the range of from about 45 to 80 degrees, preferably about 60 degrees, as measured from the line of the associated flange way.

Figure 2:
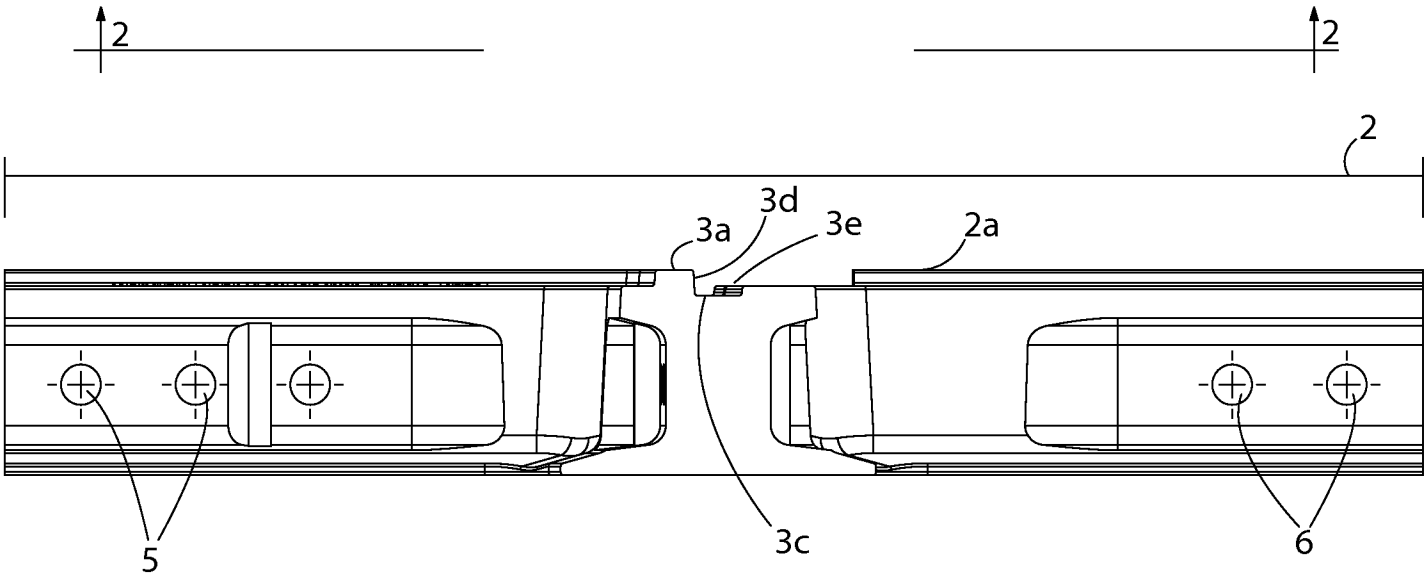
FIG. 2 is a side elevation view of a center frog casting in accordance with one embodiment of the present invention.

FIG. 2 shows an elevation view of a center full flange bearing center crossing frog casting 1, taken along line 2-2 of FIG. 1, in accordance with the preferred embodiment of the present invention. In this Figure, like reference numerals used in FIG. 1 refer to the same features. In this view, one can see in more detail the shape and arrangement of the main line top surface 3*a*, the main line flange way 3*b*, the main line flange way floor 3*c*, the main line internal lateral wall portion 3*d*, and the main line open external lateral side 3*e*. From this view one may also appreciate the extent of main line body portion 2, and the relative height of main line top surface 2*a*. This view also shows the position of internal joint holes 5 and external joint holes 6 that allow the casting to be produced and assembled as two pieces, with an additional extension piece that extends the continuous main line flange way construct from the end of the casting, as shown in the other Figures.

Figure 3:
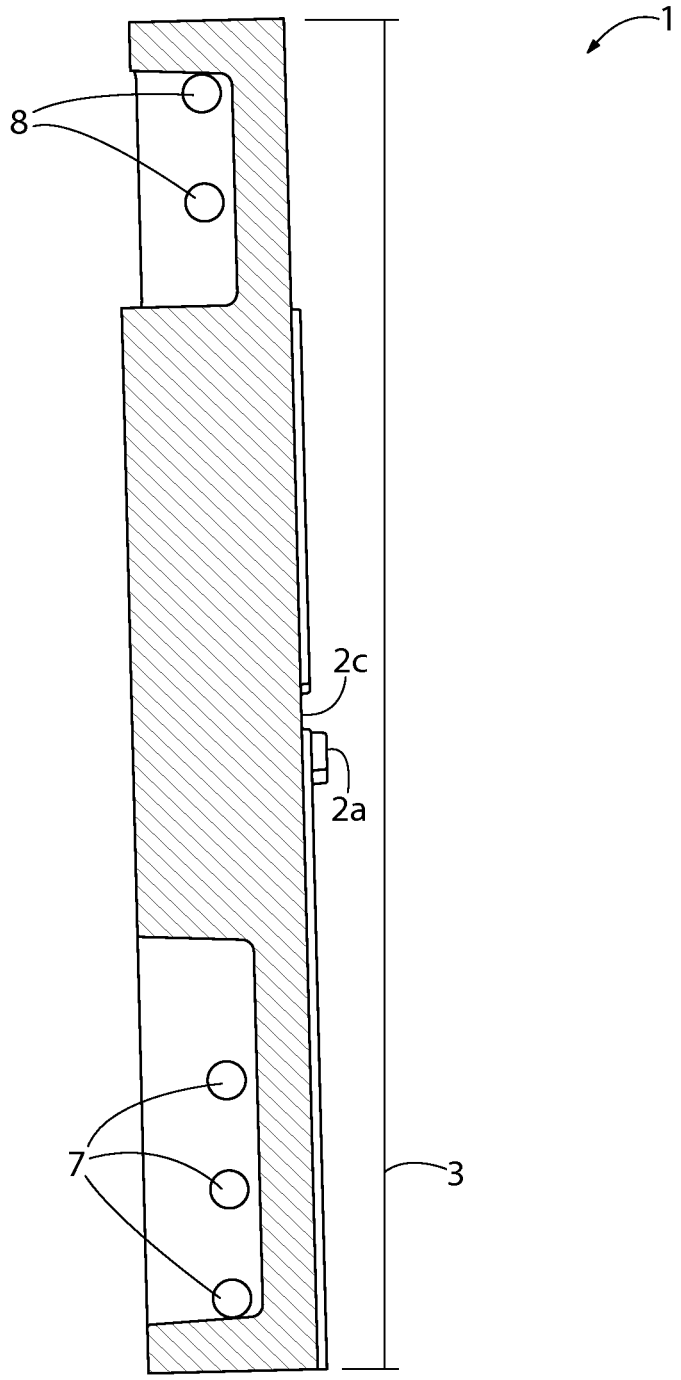
FIG. 3 is a cross-section view of a center frog casting in accordance with one embodiment of the present invention.

FIG. 3 shows an elevation view of a center full flange bearing center crossing frog casting 1, taken along line A-A of FIG. 1, in accordance with the preferred embodiment of the present invention. In this Figure, like reference numerals used in FIG. 1 refer to the same features. This Figure shows the extent of main line body portion 3 with crossing line top surface 2*a* and the crossing line flange way floor 2*c* of the crossing line flange way 2*b*. From this view one may also appreciate the position of internal joint holes 7 and external joint holes 8 that allow the casting to be produced and assembled as two pieces, with an additional extension piece that extends the continuous crossing line flange way construct from the end of the casting, as shown in the other Figures.

Figure 4:
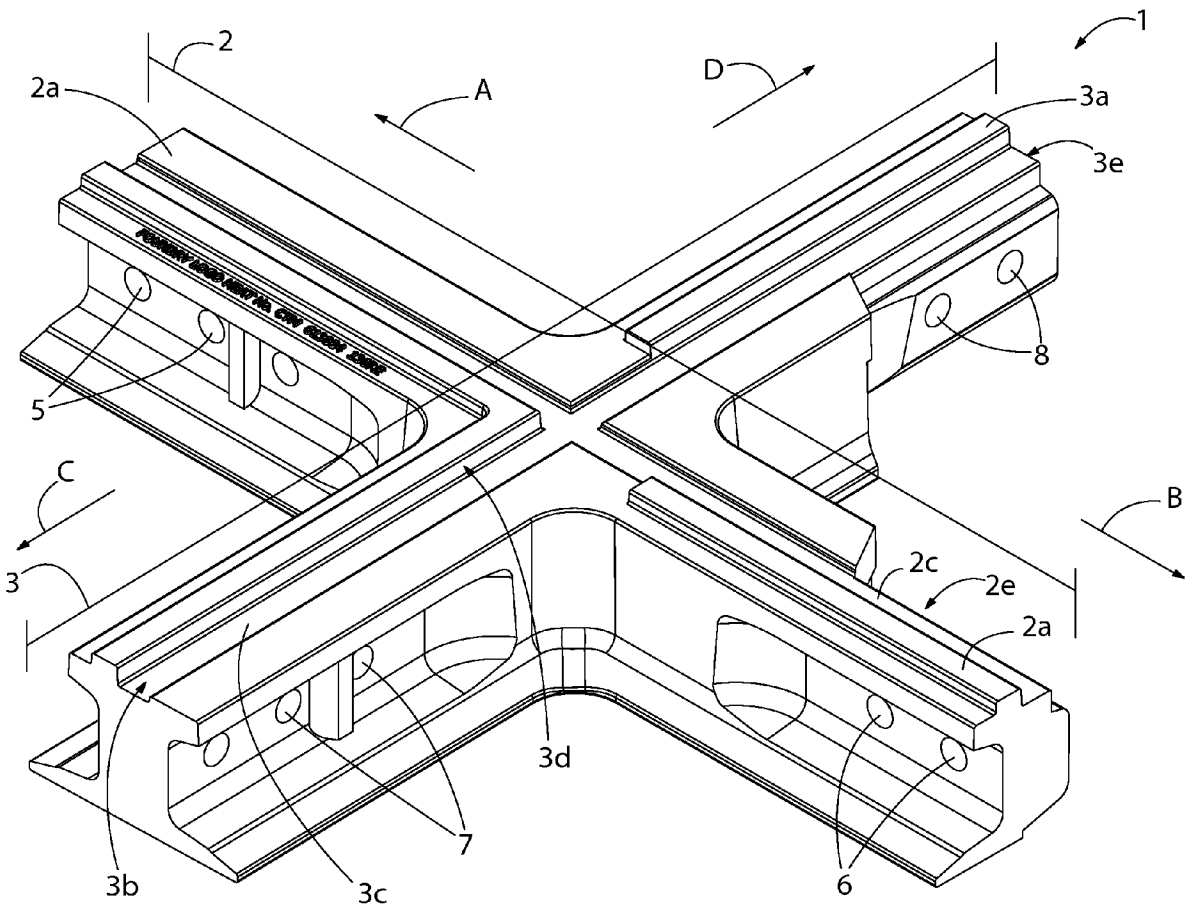
FIG. 4 is an upper perspective view of a center frog casting in accordance with one embodiment of the present invention.

FIG. 4 shows an isomeric perspective view of a center full flange bearing center crossing frog casting 1, taken approximately along the direction of line 4-4 of FIG. 1. In this Figure, like reference numerals used in FIG. 1 refer to the same features. In this view one can appreciate the relative size and orientation of the crossing line body portion 2 (that will extend within the crossing line way, in direction A, and outside the crossing line way, in direction B, once the arrangement is assembled) having a crossing line top surface 2*a* and a crossing line flange way 2*b*, the crossing line flange way comprising: (1) a crossing line flange way floor 2*c* and (2) a crossing line internal lateral wall portion 2*d*; and (3) a crossing line open external lateral side 2*e*. Also shown is the main line body portion 3 (that will extend within the crossing line way, in direction C, and outside the crossing line way, in direction D, once the arrangement is assembled) having a main line top surface 3*a* and a main line flange way 3*b*, the main line flange way comprising: (1) a main line flange way floor 3*c* and (2) a main line internal lateral wall portion 3*d*; and (3) a main line open external lateral side 3*e*.

The crossing line flange way floor 2*c* and the main line flange way floor 3*c* form an intersection 4 at an intersection level.

The center crossing frog casting 1 is adapted to be provided with spaces alongside crossing line open external lateral side 2*e* and the main line open external lateral side 3*e* that accommodate the placement of a rail such each may reside astride the respective flange way floors, so as to form an external lateral flange way wall opposite the corresponding internal lateral wall portion.

Figure 5:
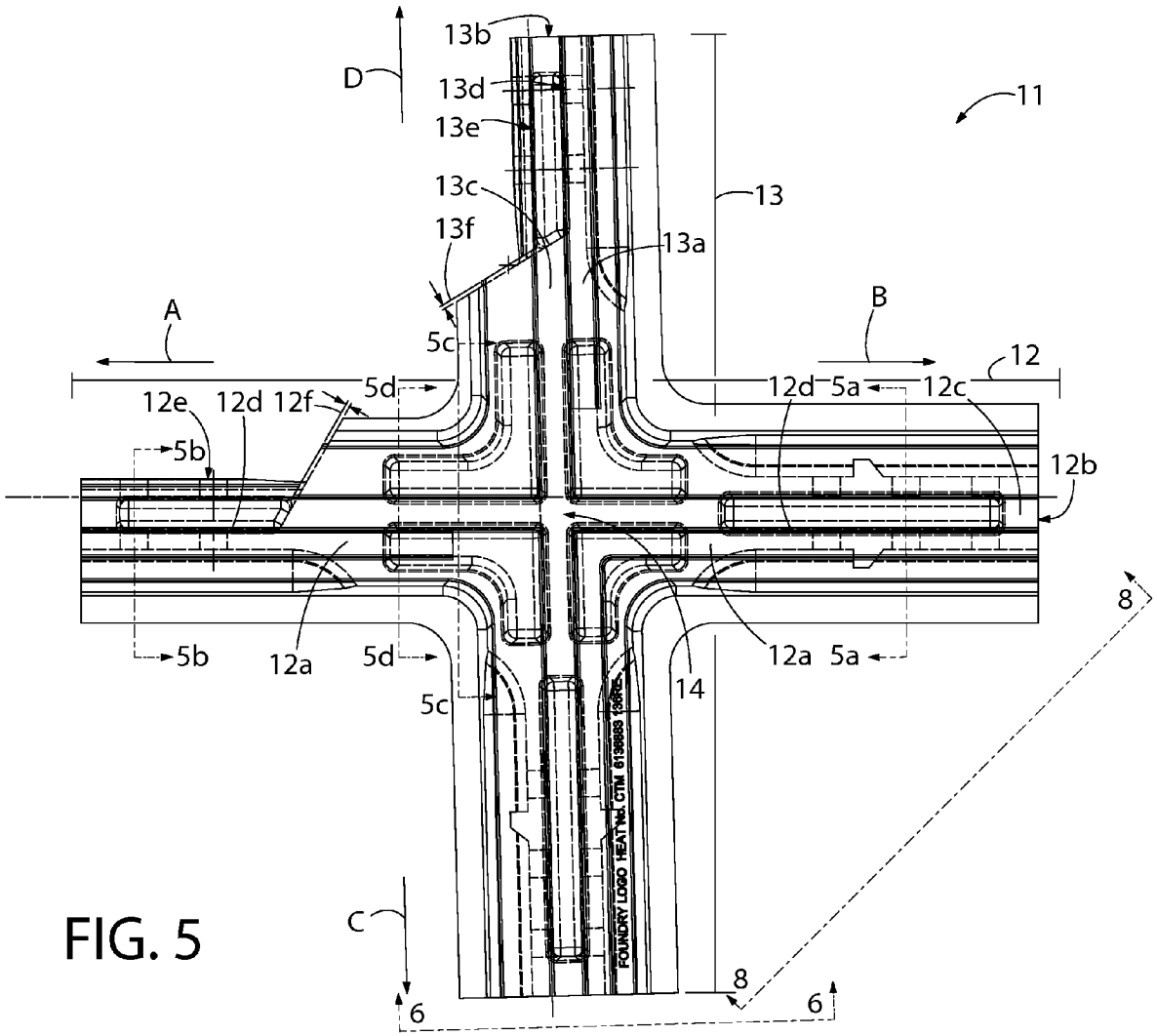
FIG. 5 is a plan view of an end frog casting in accordance with one embodiment of the present invention.

FIG. 5 shows a plan view of an end full flange bearing rail crossing frog casting 11 in accordance with the preferred embodiment of the present invention.

This frog will be part of a full flange bearing rail crossing frog casting arrangement of the present invention as described herein and comprising a planar arrangement of four adjacent frog castings.

The crossing frog casting 11 comprises a main line body portion 12 (that will extend within the crossing line way, in direction A, and outside the crossing line way, in direction B, once the arrangement is assembled) having a crossing line top surface 12*a* and a crossing line flange way 12*b*, the crossing line flange way comprising: (1) a crossing line flange way floor 12*c* and (2) a crossing line internal lateral wall portion 12*d*; and (3) a crossing line open external lateral side 12*e*.

The crossing frog casting 11 also comprises a main line body portion 13 (that will extend within the crossing line way, in direction C, and outside the crossing line way, in direction D, once the arrangement is assembled), and having a main line top surface 13*a* and a main line flange way 13*b*, the main line flange way comprising: (1) a main line flange way floor 13*c* and (2) a main line internal lateral wall portion 13*d*; and (3) a main line open external lateral side 13*e*.

The crossing line flange way floor 12*c* and the main line flange way floor 13*c* form an intersection 14 at an intersection level.

The rail crossing frog casting 11 is adapted to be provided with spaces alongside the crossing line open external lateral side 12*e* and the main line open external lateral side 13*e* that accommodate the placement of a rail such that it may reside astride the respective flange way floors, so as to form an external lateral flange way wall opposite the corresponding internal lateral wall portion.

FIG. 5 also shows the respective casting faces 12*f* and 13*f* that conform to the corresponding shape of the terminal end of the rail may be placed astride the respective flange way floors.

Figure 5A:
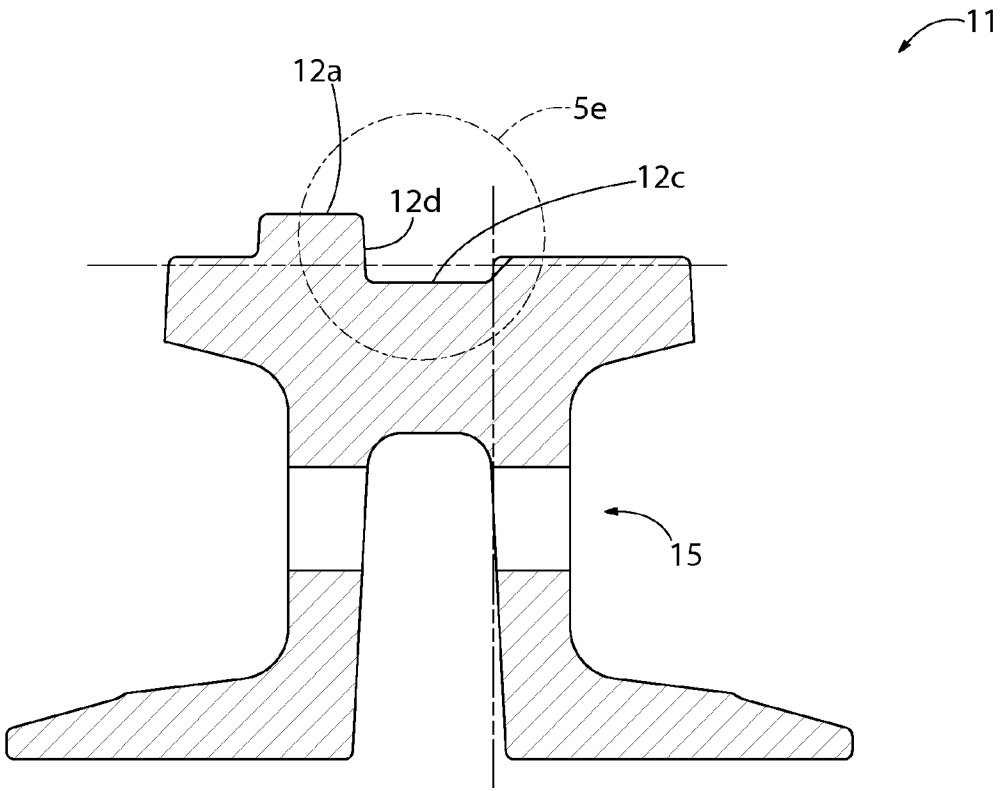
FIG. 5*a* is a cross section view taken along line A-A of FIG. 5 in accordance with one embodiment of the present invention.

FIG. 5*a* is a cross section view taken along line A-A of FIG. 5, showing in more detail the shape of an end full flange bearing casting 11, and wherein like reference numerals used in FIG. 5 refer to the same features.

Figure 5B:
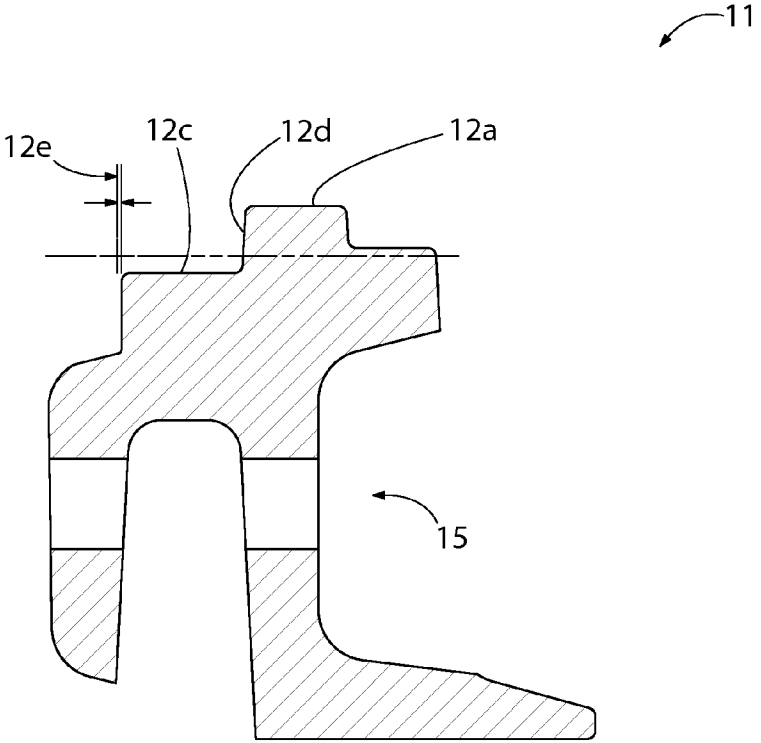
FIG. 5*b* is a cross section view taken along line B-B of FIG. 5 in accordance with one embodiment of the present invention.

FIG. 5*b* is a cross section view taken along line B-B of FIG. 5, showing in more detail the shape of an end full flange bearing casting 11, and wherein like reference numerals used in FIG. 5 refer to the same features.

Figure 5C:
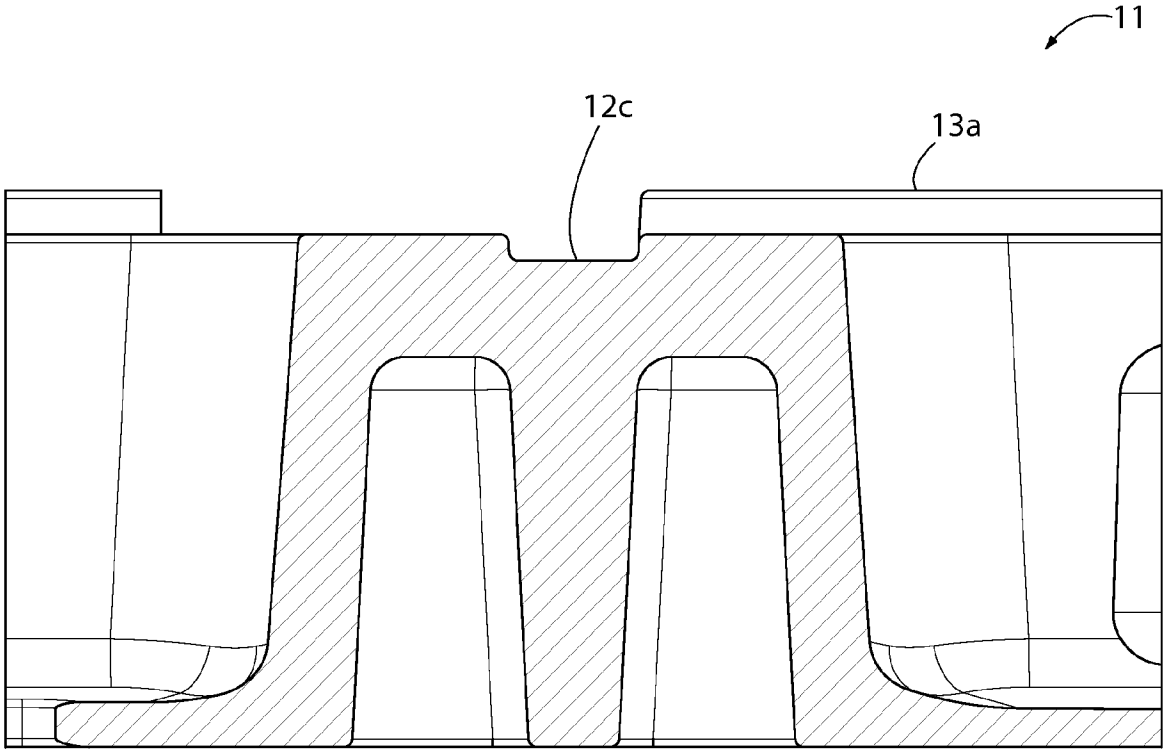
FIG. 5*c* is a cross section view taken along line C-C of FIG. 5 in accordance with one embodiment of the present invention.

FIG. 5*c* is a cross section view taken along line C-C of FIG. 5, showing in more detail the shape of an end full flange bearing casting 11, and wherein like reference numerals used in FIG. 5 refer to the same features.

Figure 5D:
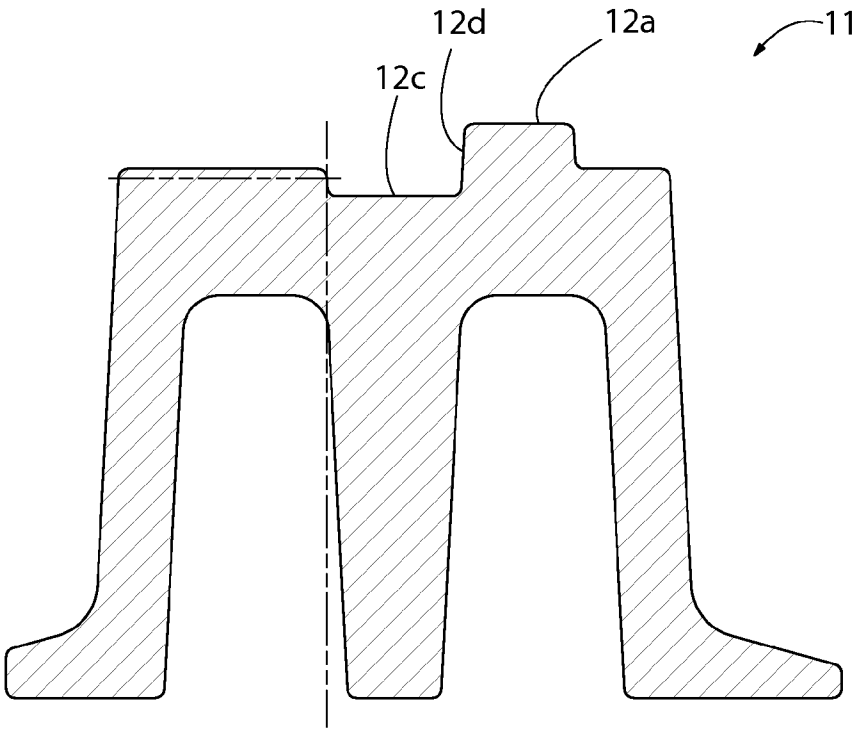
FIG. 5*d* is a cross section view taken along line F-F of FIG. 5 in accordance with one embodiment of the present invention.

FIG. 5*d* is a cross section view taken along line F-F of FIG. 5, showing in more detail the shape of an end full flange bearing casting 11, and wherein like reference numerals used in FIG. 5 refer to the same features.

Figure 5E:
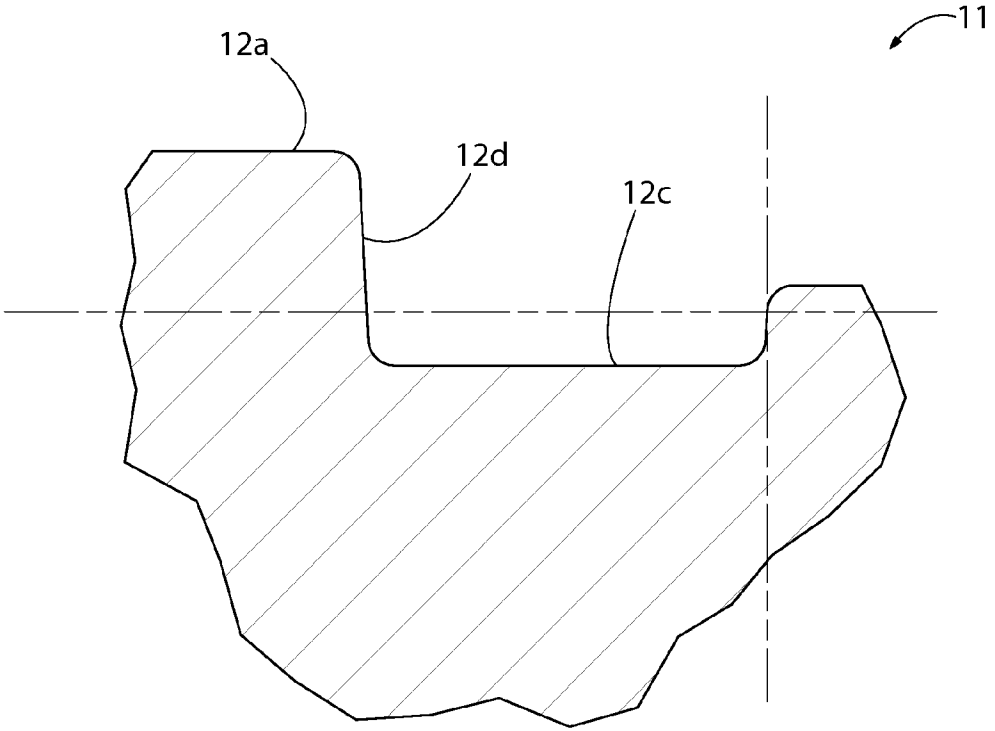
FIG. 5*e* is a cross section view of detail E of FIG. 5*a* in accordance with one embodiment of the present invention.

FIG. 5*e* is a cross section view of detail E of FIG. 5*a*, showing in more detail the shape of an end full flange bearing casting 11, and wherein like reference numerals used in FIG. 5 refer to the same features.

Figure 6:
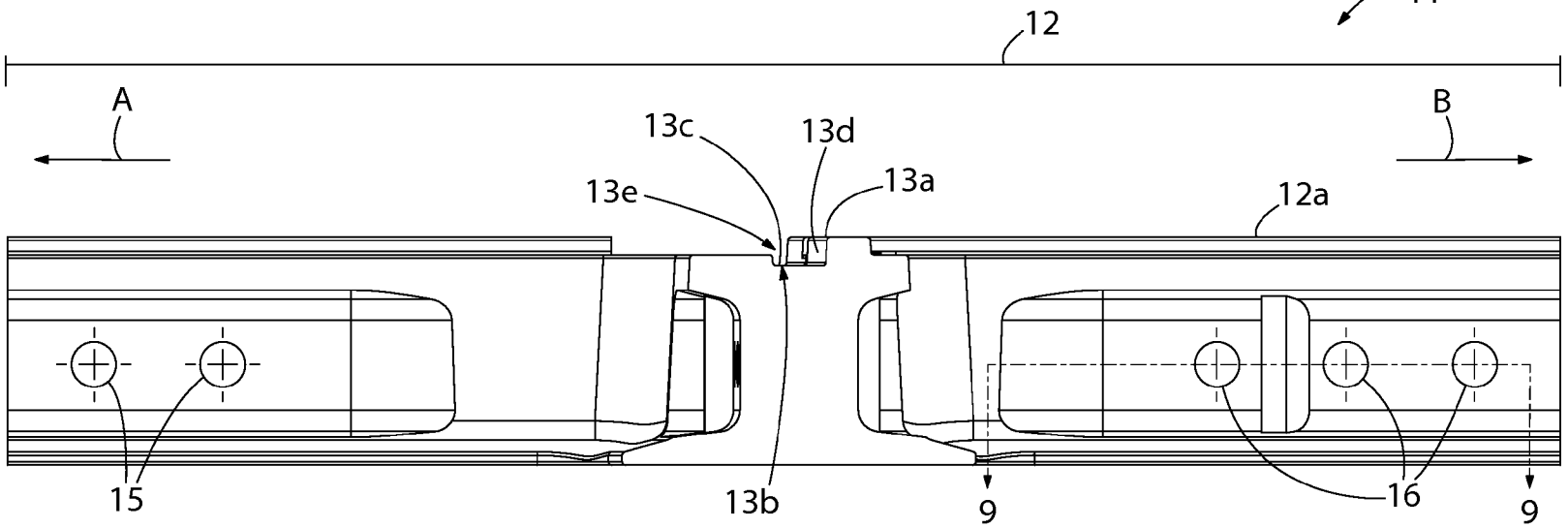
FIG. 6 shows an elevation view of an end full flange bearing rail crossing frog casting, taken along line 6-6 of FIG. 5, in accordance with the preferred embodiment of the present invention.

FIG. 6 shows an elevation view of an end full flange bearing rail crossing frog casting 11, taken along line 6-6 of FIG. 5, in accordance with the preferred embodiment of the present invention. In this Figure, like reference numerals used in FIG. 5 refer to the same features. In this view, one can see in more detail the shape and arrangement of the main line top surface 13*a*, the main line flange way 13*b*, the main line flange way floor 13*c*, the main line internal lateral wall portion 13*d*, and the main line open external lateral side 13*e*. From this view one may also appreciate the extent of crossing line body portion 12, and the relative height of crossing line top surface 12*a*. This view also shows the position of internal joint holes 15 and external joint holes 16 that allow the casting to be produced and assembled as two pieces, with an additional extension piece that extends the continuous crossing line flange way construct from the end of the casting, as shown in the other Figures.

Figure 7:
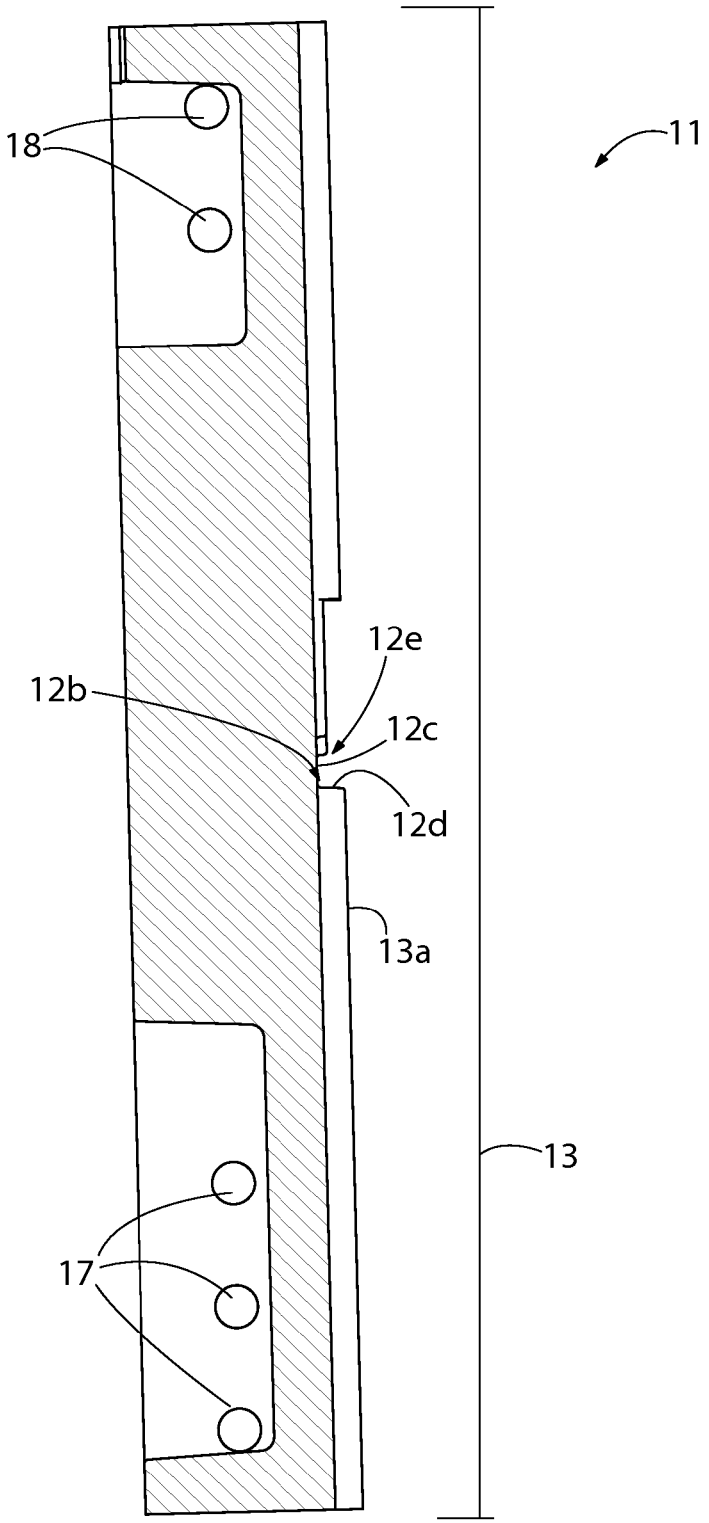
FIG. 7 shows an elevation view of a center full flange bearing rail crossing frog casting, taken along line C-C of FIG. 5, in accordance with the preferred embodiment of the present invention.

FIG. 7 shows an elevation view of a center full flange bearing rail crossing frog casting 11, taken along line C-C of FIG. 5, in accordance with the preferred embodiment of the present invention. In this Figure, like reference numerals used in FIG. 5 refer to the same features. This Figure shows the extent of main line body portion 13 with main line top surface

13*a* and the main line flange way floor 13*c* of the main line flange way 13*b*. From this view one may also appreciate the position of internal joint holes 17 and external joint holes 18 that allow the casting to be produced and assembled as two pieces, with an additional extension piece that extends the continuous crossing line flange way construct from the end of the casting, as shown in the other Figures.

Figure 8:
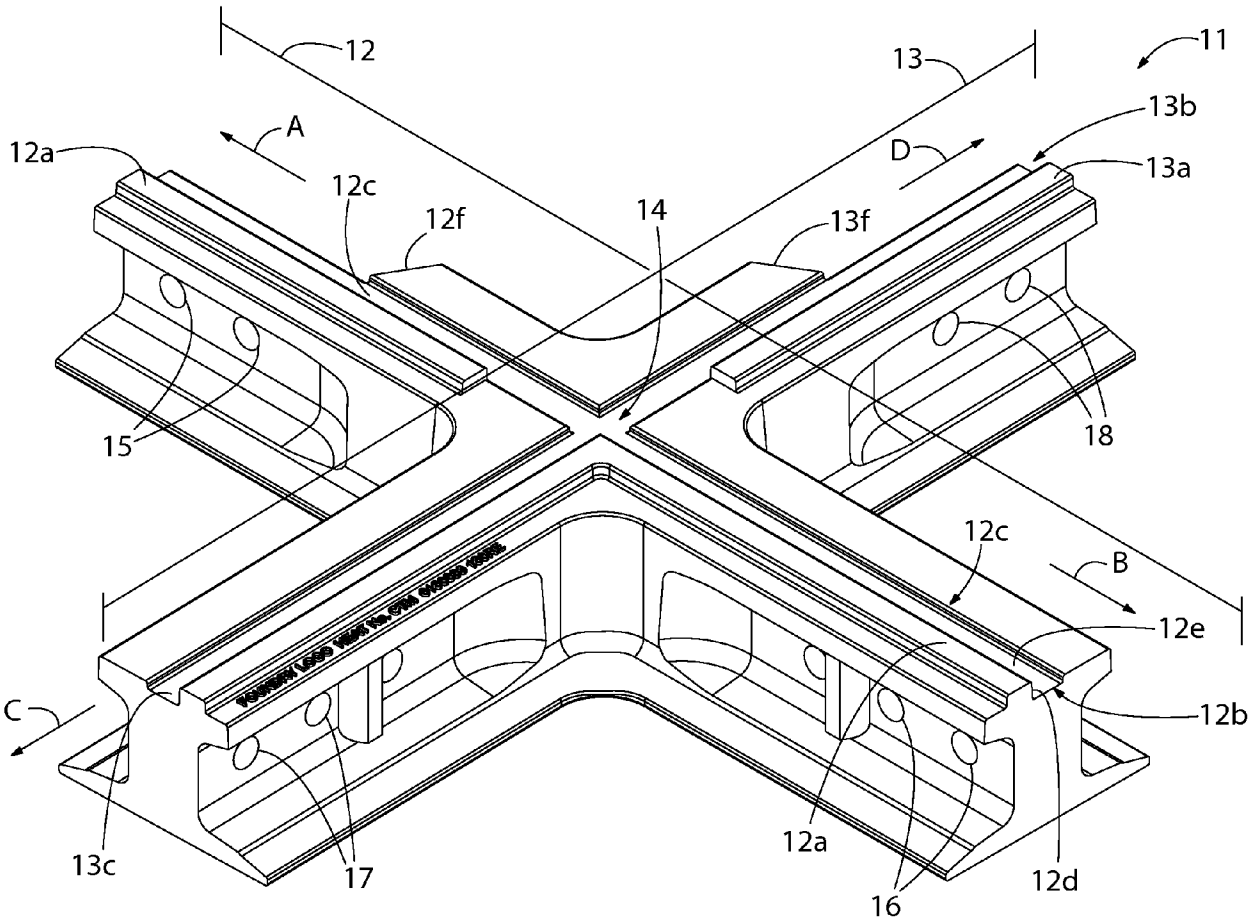
FIG. 8 shows an isomeric perspective view of a center full flange bearing frog casting, taken approximately along the direction of line 8-8 of FIG. 5, in accordance with one embodiment of the present invention.

FIG. 8 shows an isomeric perspective view of a center full flange bearing frog casting 11, taken approximately along the direction of line 8-8 of FIG. 5. In this Figure, like reference numerals used in FIG. 5 refer to the same features. In this view one can appreciate the relative size and orientation of the crossing line body portion 12 (that will extend within the crossing line way, in direction A, and outside the crossing line way, in direction B, once the arrangement is assembled) having a crossing line top surface 12*a* and a crossing line flange way 12*b*, the crossing line flange way comprising: (1) a crossing line flange way floor 12*c* and (2) a crossing line internal lateral wall portion 12*d*; and (3) a crossing line open external lateral side 12*e*. Also shown is the main line body portion 3 (that will extend within the crossing line way, in direction C, and outside the crossing line way, in direction D, once the arrangement is assembled) having a crossing line top surface 13*a* and a crossing line flange way 13*b*, the crossing line flange way comprising: (1) a crossing line flange way floor 13*c* and (2) a crossing line internal lateral wall portion 13*d*; and (3) a crossing line open external lateral side 3*e*.

The crossing line flange way floor 12*c* and the crossing line flange way floor 13*c* form an intersection 14 at an intersection level.

The center full flange bearing frog casting 11 is adapted to be provided with spaces alongside crossing line open external lateral side 12*e* and the crossing line open external lateral side 13*e* that accommodate the placement of a rail such that it may be placed astride the respective flange way floors, so as to form an external lateral flange way wall opposite the corresponding internal lateral wall portion.

FIG. 8 also shows the respective casting faces 12*f* and 13*f* that conform to the corresponding shape of the terminal end of the rail may be placed astride the respective flange way floors.

Figure 9:
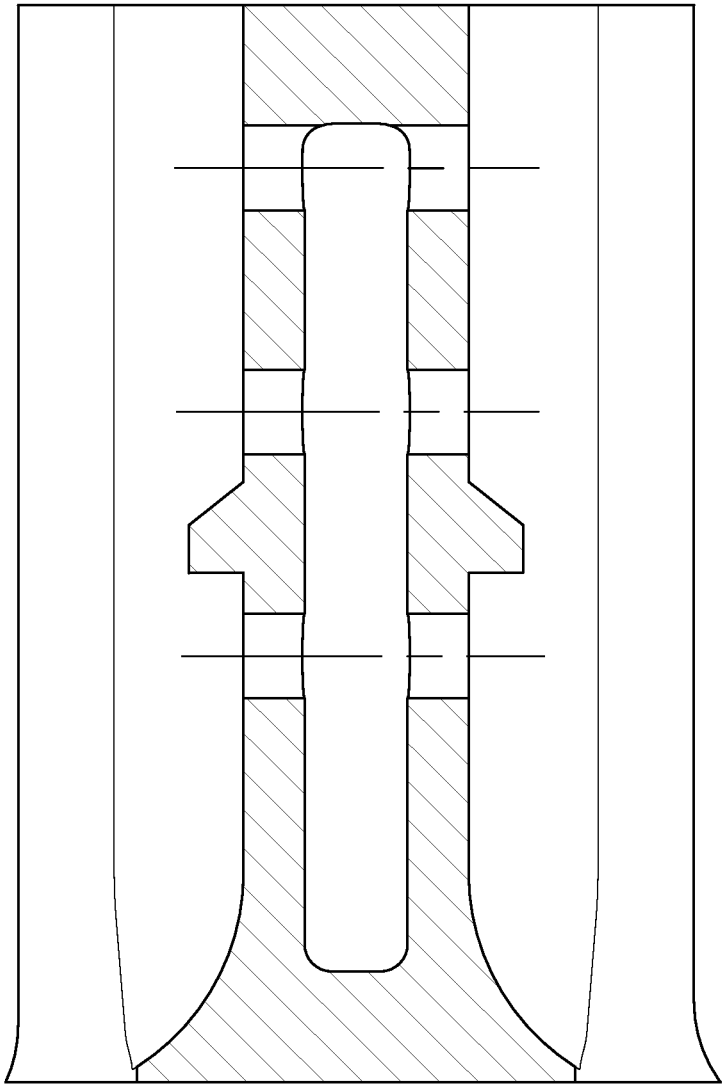
FIG. 9 is a cross section view taken along line D-D of FIG. 5.

FIG. 9 is a cross section view taken along line D-D of FIG. 6.

Figure 10:
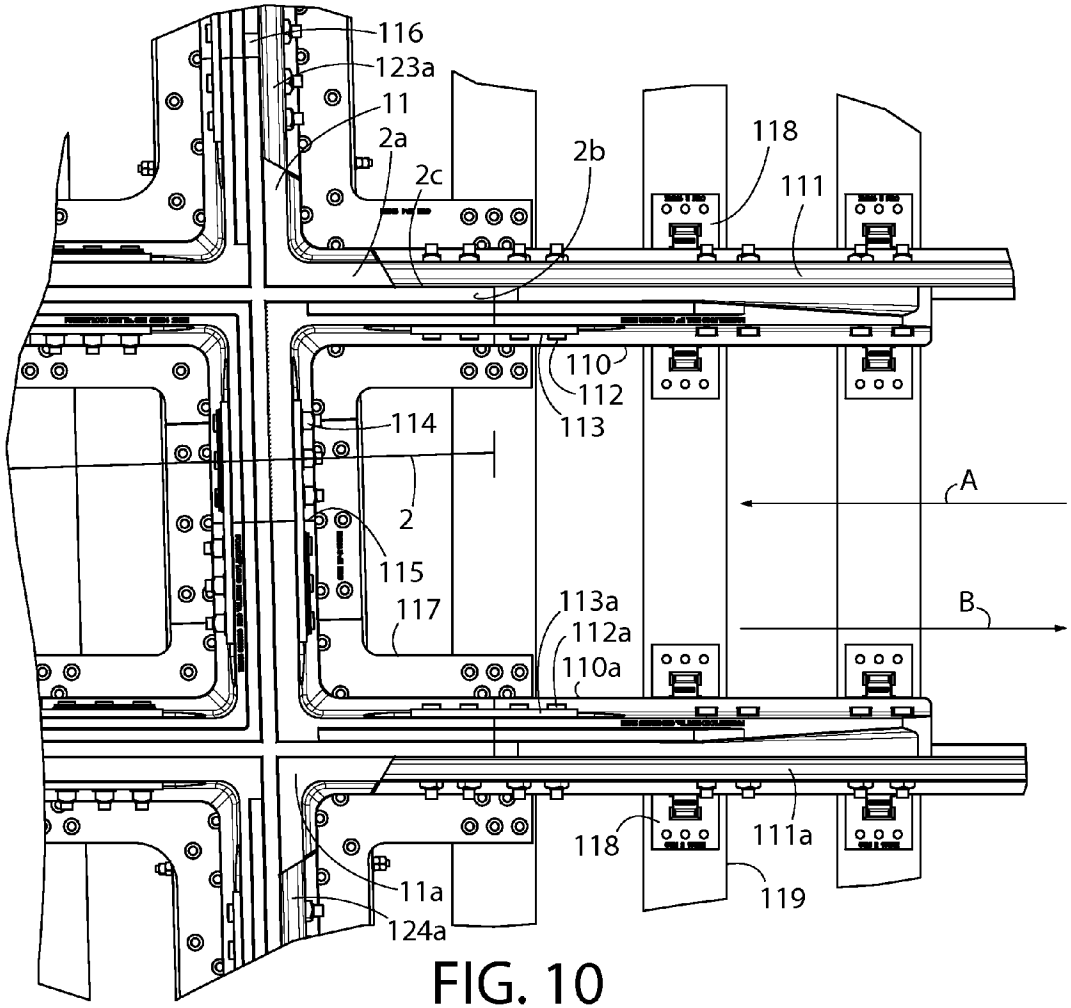
FIG. 10 is a detailed plan view of a portion of a crossing panel constructed using two end full flange bearing castings, which are mirror image of one another, in accordance with one embodiment of the present invention.

FIG. 10 is a detailed plan view of a portion of a crossing panel constructed using two end full flange bearing castings 11 and 11*a*, which are mirror images of one another, as are the respective extension portions 110 and 110*a* that extend respectively therefrom, and secured to one another, respectively, by bolts 112 and plate 113 and by bolts 112*a* and plate 113*a*. The two end full flange bearing castings 11 and 11*a* are secured to one another by bolts 112 and plate 113.

Alongside these extension portions 110 and 110*a* are laid crossing rails 111 and 111*a*. As an example, rail 111 is laid alongside and secured to end full flange bearing casting 11 and extension portion 110 such that it in essence closes the open lateral side of the flange way 2*b* (to form a second side of a completely walled flange way along opposite internal lateral wall portion 2*d* and along open external lateral side 2*e*), and such that its tread bearing surface is at substantially the same height as top surface 2*a*. Rail 111 is laid alongside and secured to end full flange bearing casting 11*a* and extension portion 110*a* in like manner.

As may be appreciated from FIG. 10, as the flange way floor wears from repetitive contact with rail wheels sets progressing along path A, the flange way will become progressively worn deeper into the flange way. As this occurs, one of the benefits of the present invention is that the tread bearing surface of the rail adjacent to the worn flange way will be able to bear the wheel in a tread-bearing disposition, rather than the upper surface of the casting itself (as in prior art designs).

In addition, one of the advantages of the multi-piece construction is that the extension portion may be replaced separately, thus further avoiding having to replace an entire large casting. This preferred arrangement thus further extends the lifetime of the crossing panel arrangement through selective replacement of worn extension portions.

The crossing panel typically will be assembled by incorporating the castings into a planar array atop support plates, such as main plate 117 (which may be comprised of a single plate or multiple plates), and individual tie plates 118 atop tie 119.

Figure 11:
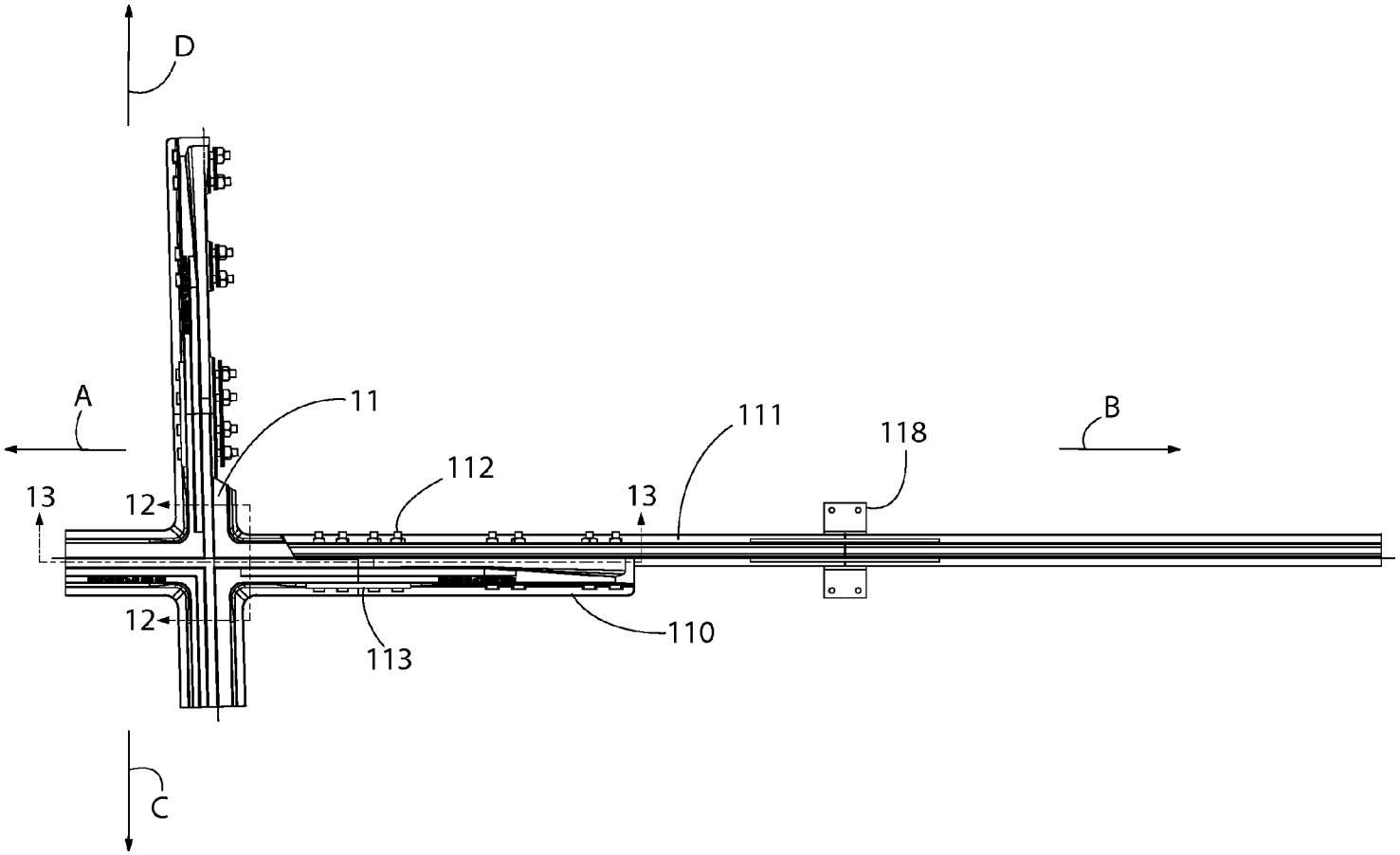
FIG. 11 is a detailed plan view of a portion of a crossing panel as shown in FIG. 10, in accordance with one embodiment of the present invention.
Figure 12:
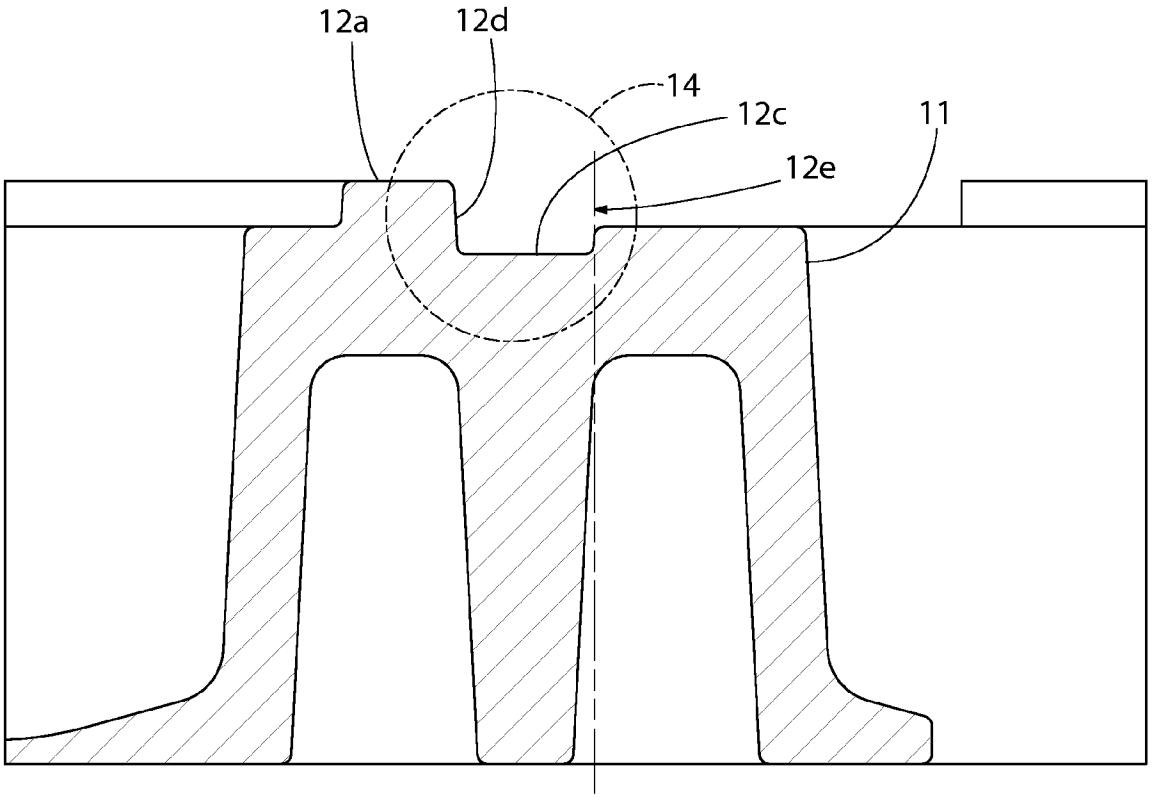
FIG. 12 is a cross section view taken along line B-B of FIG. 11, and showing in more detail the shape of an end full flange bearing casting, in accordance with one embodiment of the present invention.

FIG. 11 is a detailed plan view of a portion of a crossing panel as shown in FIG. 10, and showing in more detail a portion of the panel assembly comprising end full flange bearing casting 11, extension portion 110, bolts 112 and plate 113, and rail 111. Also shown in this view is extension portion 116 extending along direction D from end full flange bearing casting 11 along the main line path, and in position to accept a main line rail beside it in a manner similar to the way rail 111 is positioned and secured. FIG. 12 is a cross section view taken along line B-B of FIG. 11, and showing in more detail the shape of end full flange bearing casting 11.

Figure 13:
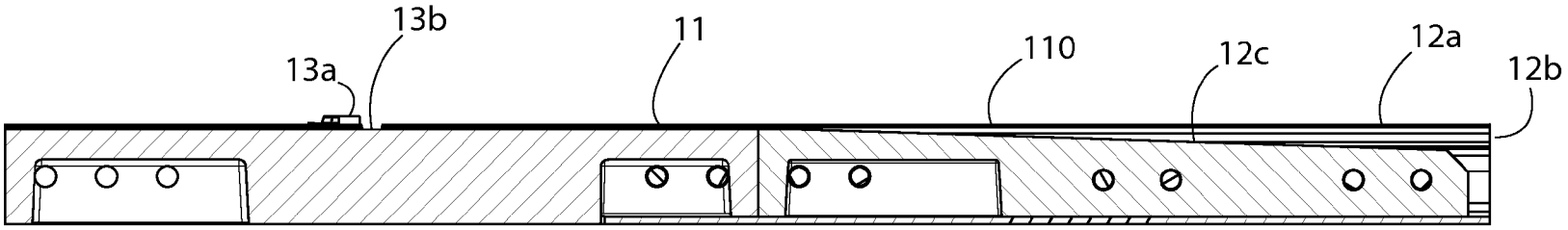
FIG. 13 is a cross section view taken along line A-A of FIG. 11, and showing in more detail the shape and placement of an end full flange bearing casting and extension portion, in accordance with one embodiment of the present invention.

FIG. 13 is a cross section view taken along line A-A of FIG. 11, and showing in more detail the shape and placement of end full flange bearing casting 11 and extension portion 110.

Figure 14:
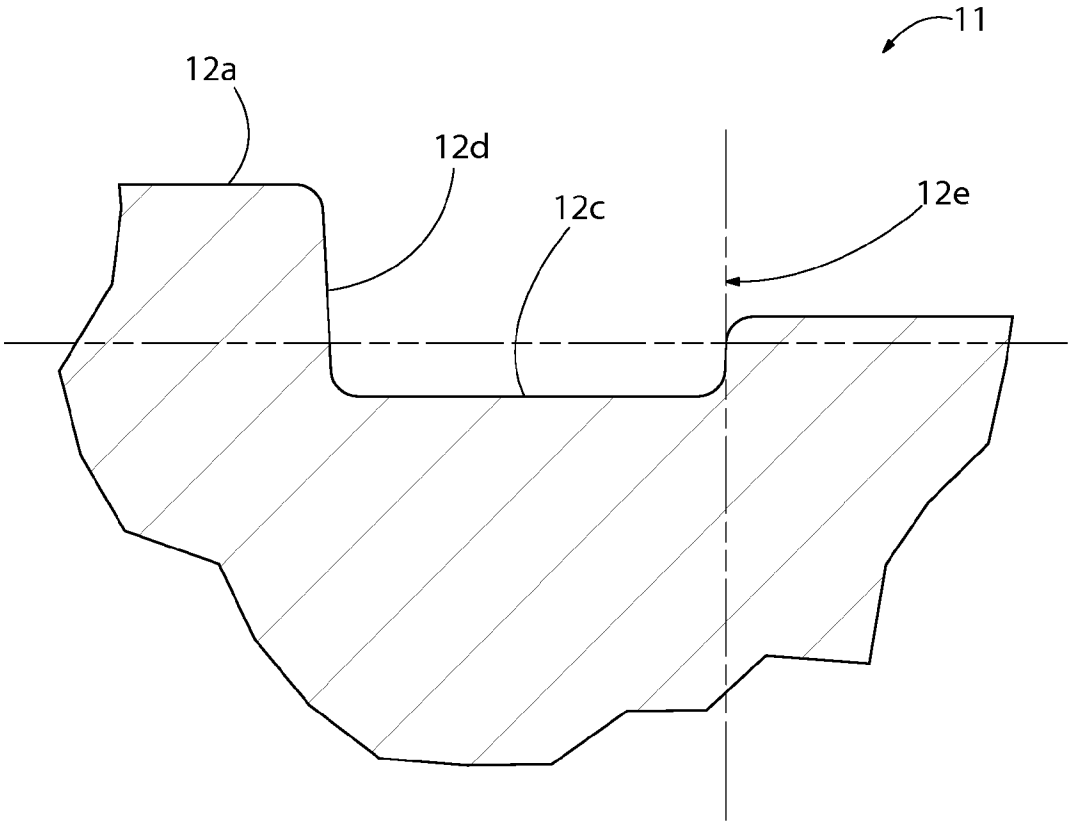
FIG. 14 is a cross section view of detail C of FIG. 12, and showing in more detail the shape of an end full flange bearing casting, in accordance with one embodiment of the present invention.

FIG. 14 is a cross section view of detail C of FIG. 12, and showing in more detail the shape of end full flange bearing casting 11.

Figure 15:
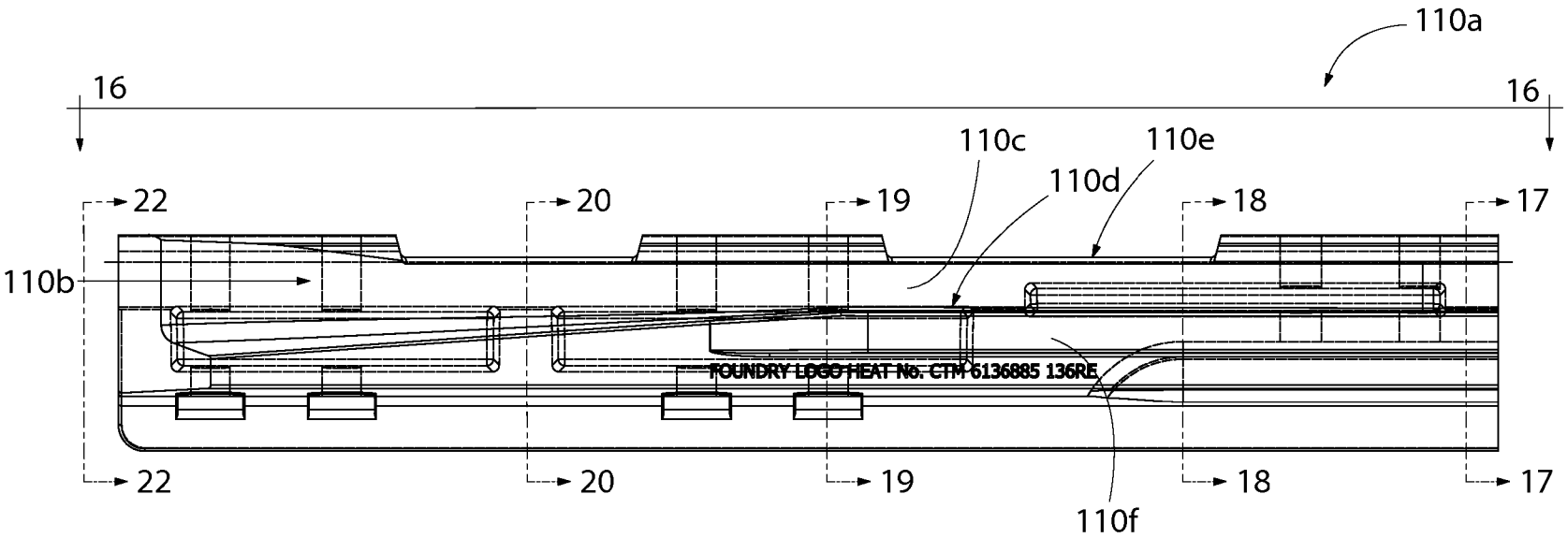
FIG. 15 is a plan view of extension portion as shown in FIG. 10.

FIG. 15 is a plan view of extension portion 110*a* as shown in FIG. 10. In this Figure, like reference numerals used in FIG. 10 refer to the same features. This Figure shows top surface 110*f* and a flange way 110*b*, the flange way comprising: (1) a flange way floor 110*c* and (2) an internal lateral wall portion 110*d* and (3) open external lateral side 110*e*; which portions align with and complement the corresponding portions of the end full flange bearing rail crossing frog casting 11*a* as shown in FIG. 10. The extension portion 110*a* may be attached through the bolts 112*a* passing through plate 113*a* and through apertures 110*g*.

Figure 16:
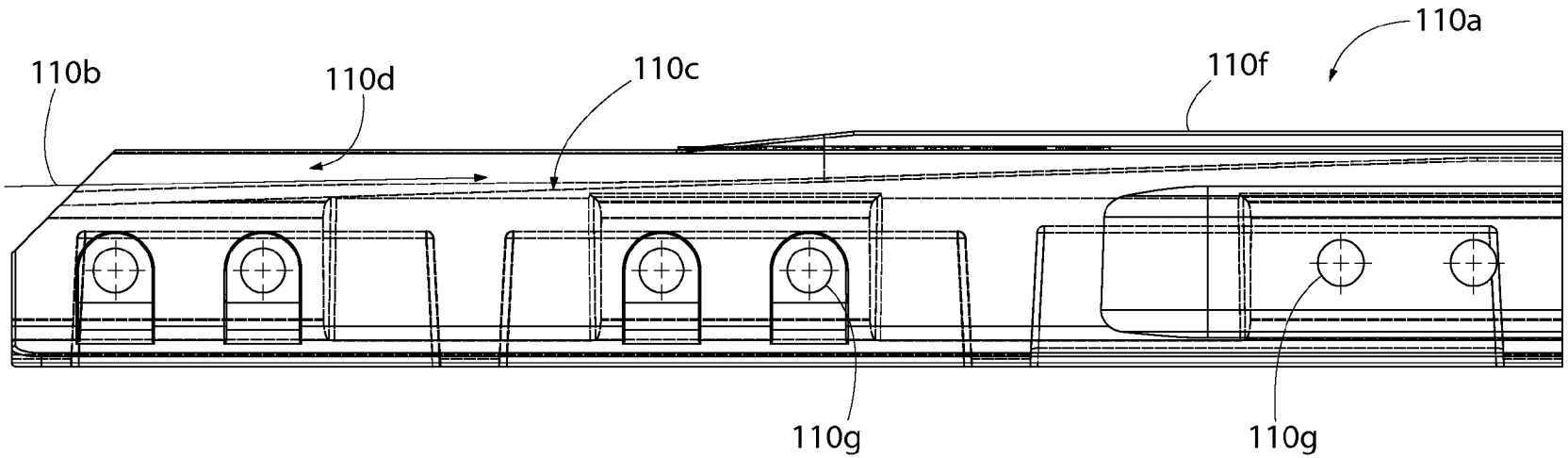
FIG. 16 is an elevation view of extension portion as shown in FIG. 10.

FIG. 16 is an elevation view of extension portion 110*a* as shown in FIG. 10. In this Figure, like reference numerals used in FIG. 10 refer to the same features.

Figure 17:
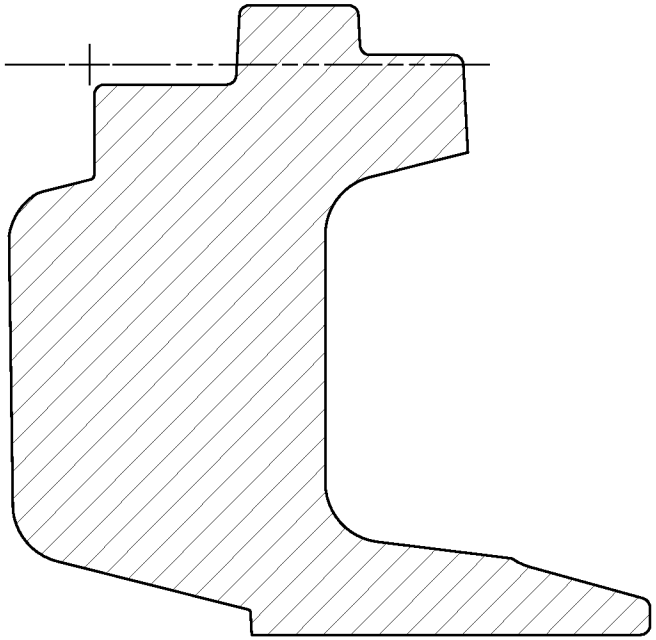
FIG. 17 is a cross section view taken along line A-A of FIG. 15.

FIG. 17 is a cross section view taken along line A-A of FIG. 15, and showing in more detail the shape of the extension portion 110*a*.

Figure 18:
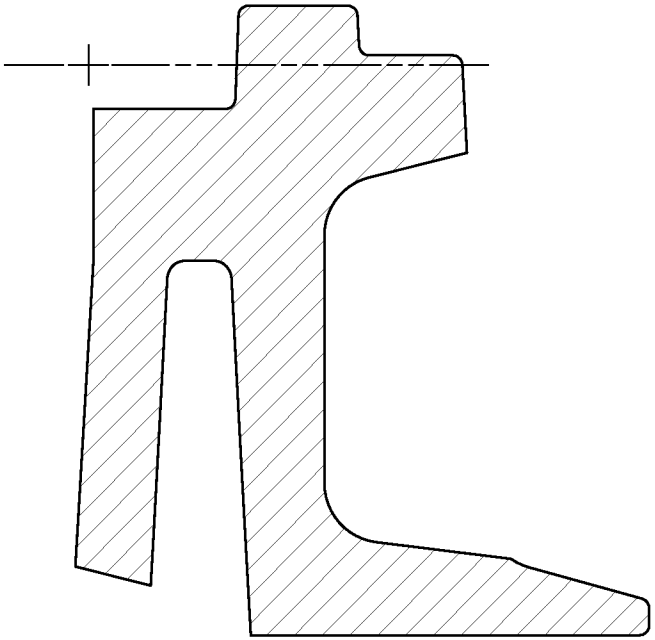
FIG. 18 is a cross section view taken along line B-B of FIG. 15.

FIG. 18 is a cross section view taken along line B-B of FIG. 15, and showing in more detail the shape of the extension portion 110*a*.

Figure 19:
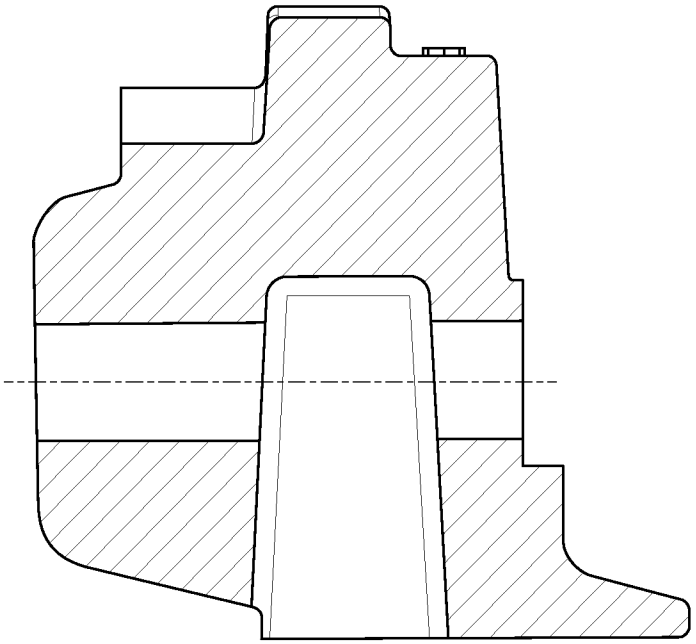
FIG. 19 is a cross section view taken along line C-C of FIG. 15.

FIG. 19 is a cross section view taken along line C-C of FIG. 15, and showing in more detail the shape of the extension portion 110*a*.

Figure 20:
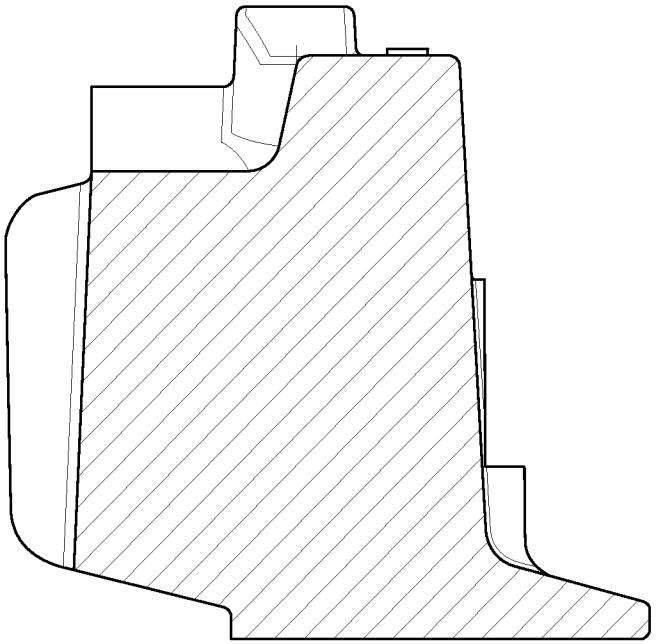
FIG. 20 is a cross section view taken along line D-D of FIG. 15.

FIG. 20 is a cross section view taken along line D-D of FIG. 15, and showing in more detail the shape of the extension portion 110*a*.

Figure 21:
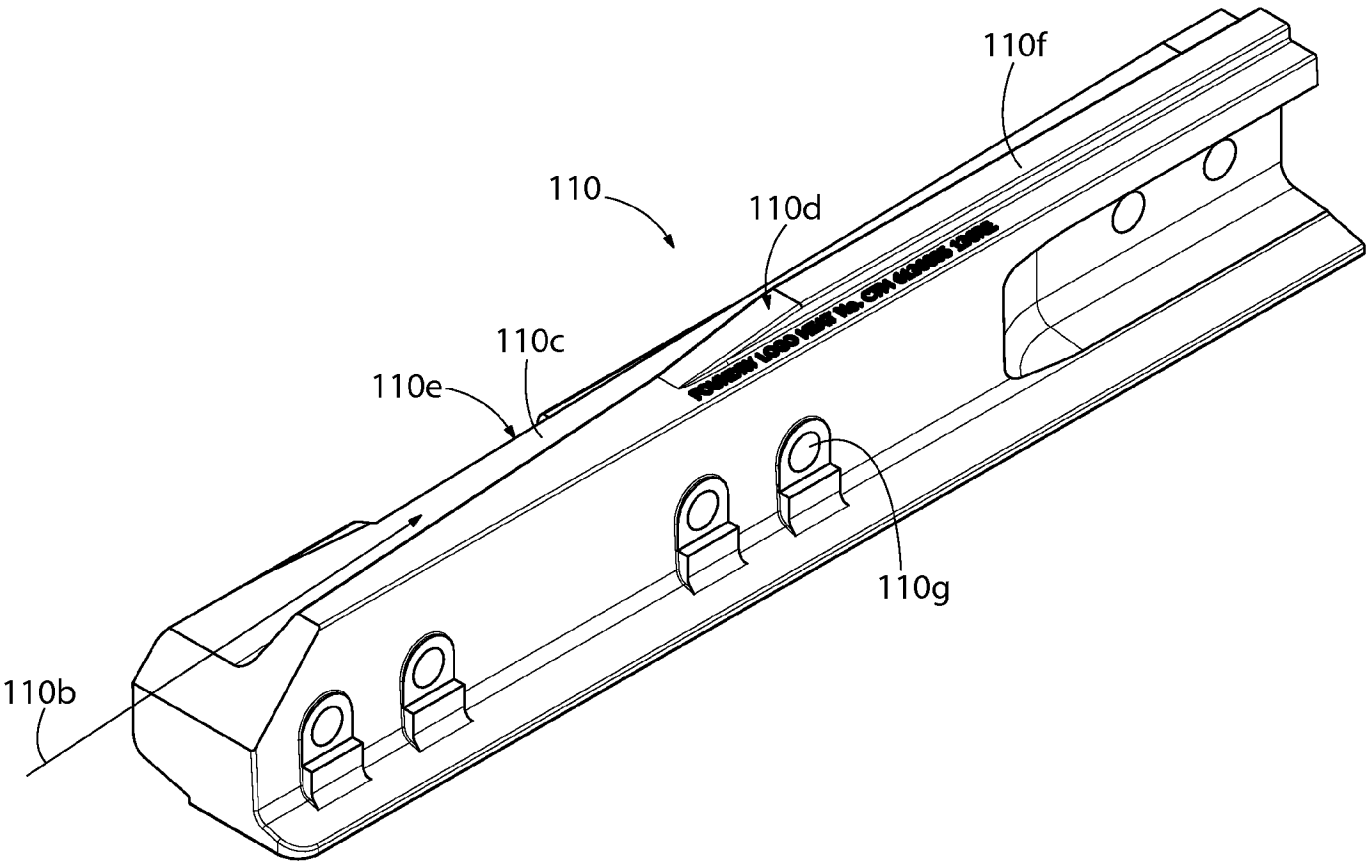
FIG. 21 is an upper perspective view of frog casting extension portion, in accordance with one embodiment of the present invention.

FIG. 21 is an upper perspective view of extension portion 110*a*.

Figure 22:
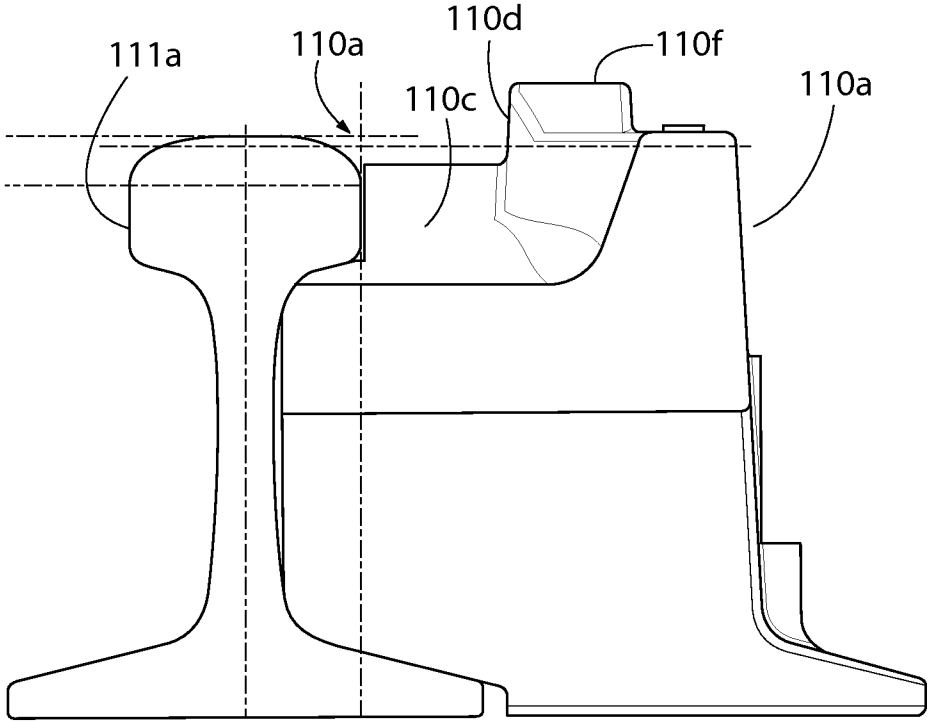
FIG. 22 is an end elevation view taken along line E-E of FIG. 15.

FIG. 22 is an end elevation view taken along line E-E of FIG. 15, and showing the relative position of rail 111*a* when affixed next to extension portion 110*a*. From this view one can appreciate the relative position of the rail 111*a* and how its inboard side serves to close open external lateral side 110*e*. In addition, one can appreciate that, as flange way 110*c* wears through repetitive impact with wheel flanges, that the tread bearing surface of rail 111*a* will bear in-coming wheels deeper into the casting's travel region, thereby allowing the wheels to be borne by the tread bearing surface of rail 111*a* through regions where the worn flange way has receded by wear. This arrangement thereby extends the overall lifetime of the casting because the upper surface of the casting is not exposed to impact or wear in regions corresponding to those regions where the worn flange way has receded by wear, which would reduce the overall lifetime of the casting, and require its complete replacement. In addition, the fact that the casting may be rendered in and assembled from two or more pieces reduces overall manufacturing costs while allowing maintenance by replacing only the lead portion (i.e., the extension portion as described herein) to maintain the frog crossing assembly in best operative condition.

Figure 23:
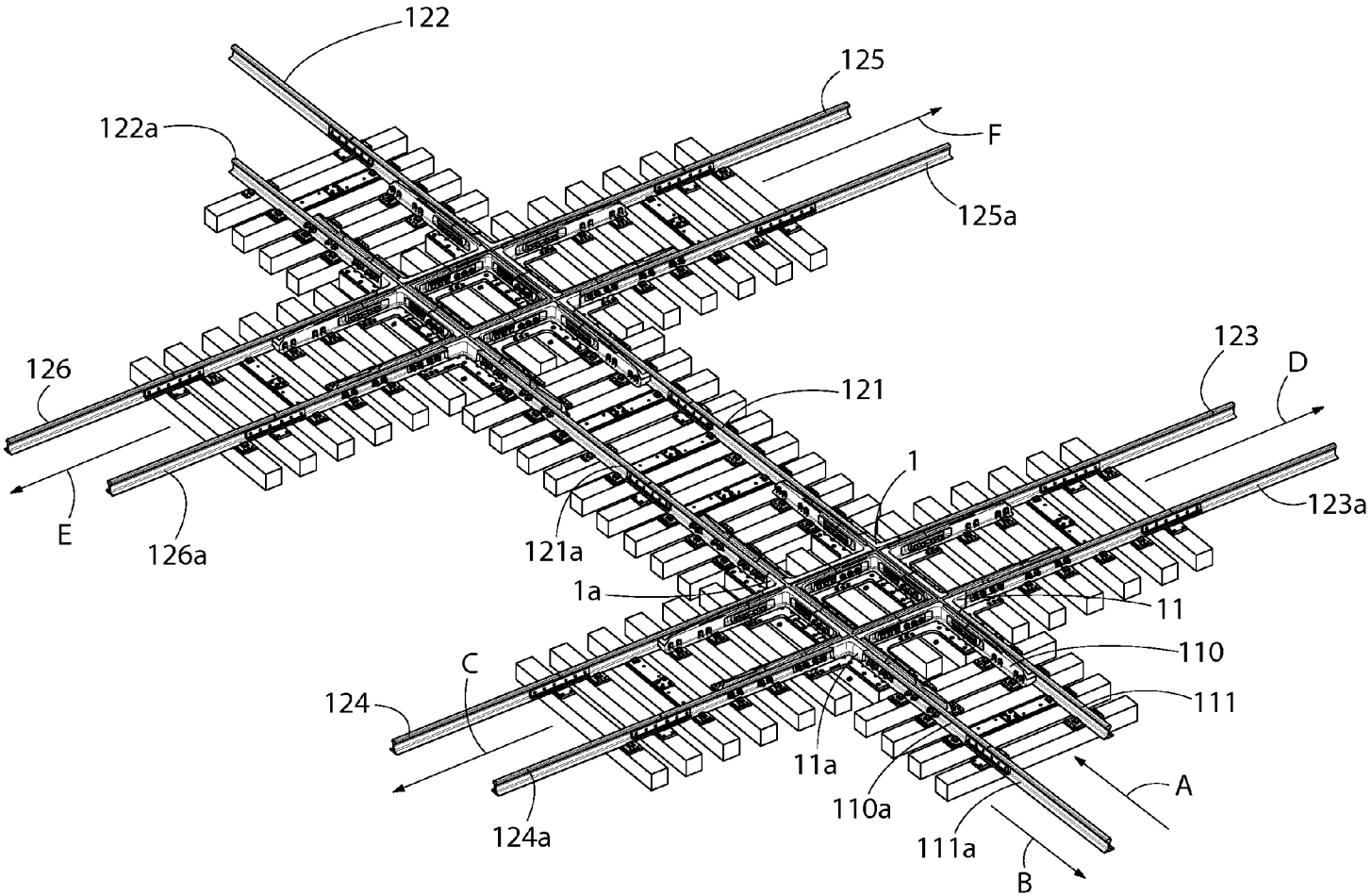
FIG. 23 is an upper perspective view of a complete crossing panel constructed using center and end full flange bearing castings and extension portions, in accordance with one embodiment of the present invention.

FIG. 23 is an upper perspective view of an assembled dual track crossing of which FIG. 10 is a partial detail and wherein like reference numerals used in FIG. 10 refer to the same features. FIG. 23 shows a dual track crossing including a crossing rail line along directions A and B (made up of rails 111 and 111*a*, intermediate rails 121 and 121*a*, and rails 122 and 122*a*) intersecting a first main line along directions C and D (made up of rails 123 and 123*a*, and rails 124 and 124*a*), and a second main line along directions E and F (made up of rails 125 and 125*a*, and rails 126 and 126*a*). It will be appreciated that intermediate rails 121 and 121*a* maintain the height of flange-borne wheels at a crossing height as they approach—and pass through—the second intersection (crossing path E-F), following which they are returned to the running height by travelling onto the flange way of the downstream end casting pair, mirroring the action of end full flange bearing castings 11 and 11*a*.

The crossing panel is constructed using two end full flange bearing castings 11 and 11*a* and respective extension portions 110 and 110*a* that extend respectively therefrom. It will be appreciated that wheel sets travelling along direction A will first encounter full flange bearing castings 11 and 11*a* (or their extension portions 110 and 110*a* where provided), and be lifted to a crossing height. In operation, a wheel on a rail approaching an intersection with another rail in the first instance will have its flange engaged by the inclined flange way floor which raises the wheel to a crossing level height at which height it is maintained as it crosses one or more pairs of intersecting rails by traversing the guiding flange way path provided by the assembled castings. Following its transition across the last flange way intersection, the wheel will be returned to its running height by following the trailing incline of the end frog casting.

As shown and described further herein, the each frog casting will arranged such that respective adjacent main line flange way floors are aligned and adjacent crossing line flange way floors are aligned.

It will be appreciated that the end full flange bearing castings 11 and 11*a* will have an angled flange way floor presented to a travelling wheel when approached from two directions (i.e., along direction A and C for end full flange bearing casting 11, and along direction A and D for end full flange bearing casting 11), while otherwise the flange ways are substantially level. By contrast, the center full flange bearing castings 1 and 1*a* will have an angled flange way floor only when approached, respectively, along direction C and D. Otherwise the flange ways of these center castings are substantially level to maintain the wheel at a crossing height.

Where a single crossing is desired, one may be constructed by arranging four end full flange bearing castings, essentially duplicating the arrangement of end full flange bearing castings 11 and 11*a*, such that an approaching wheel set is raised to a crossing height as it approaches the intersecting line, and then is returned to its running height by following the trailing incline of the far side end frog castings.

Figure 24:
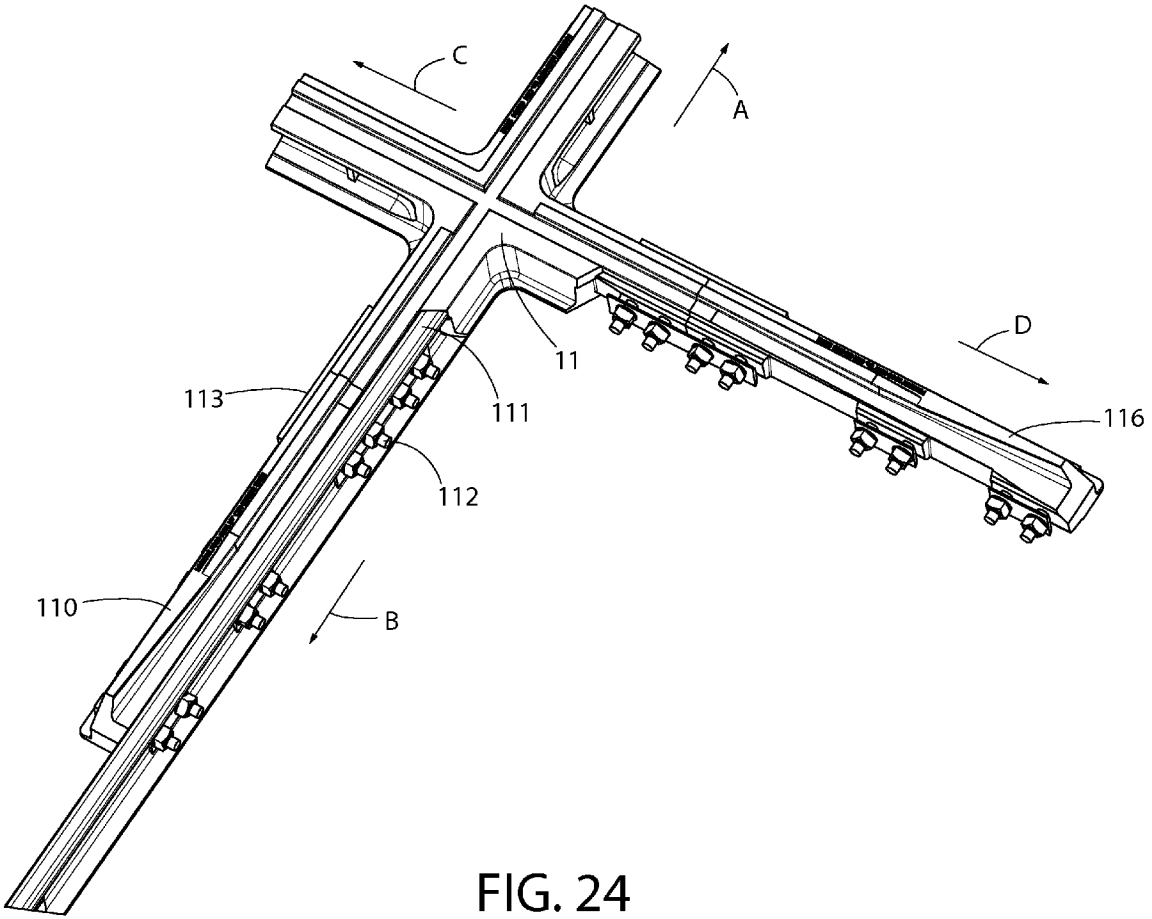
FIG. 24 is an upper perspective view of an assembly of an end full flange bearing casting with extension portions and an associated rail, in accordance with one embodiment of the present invention.
Figure 25:
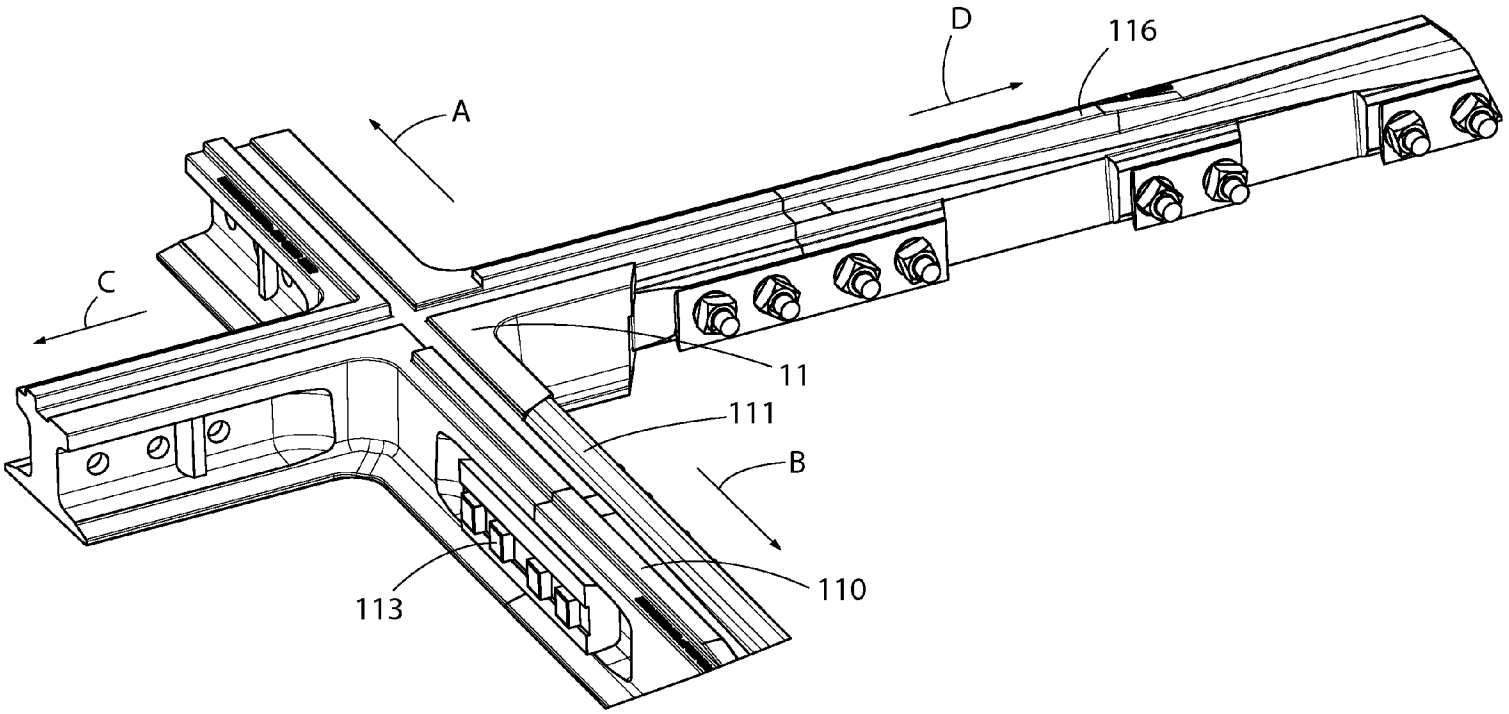
FIG. 25 is another upper perspective view of an assembly of an end full flange bearing casting with extension portions and an associated rail, in accordance with one embodiment of the present invention.
Figure 26:
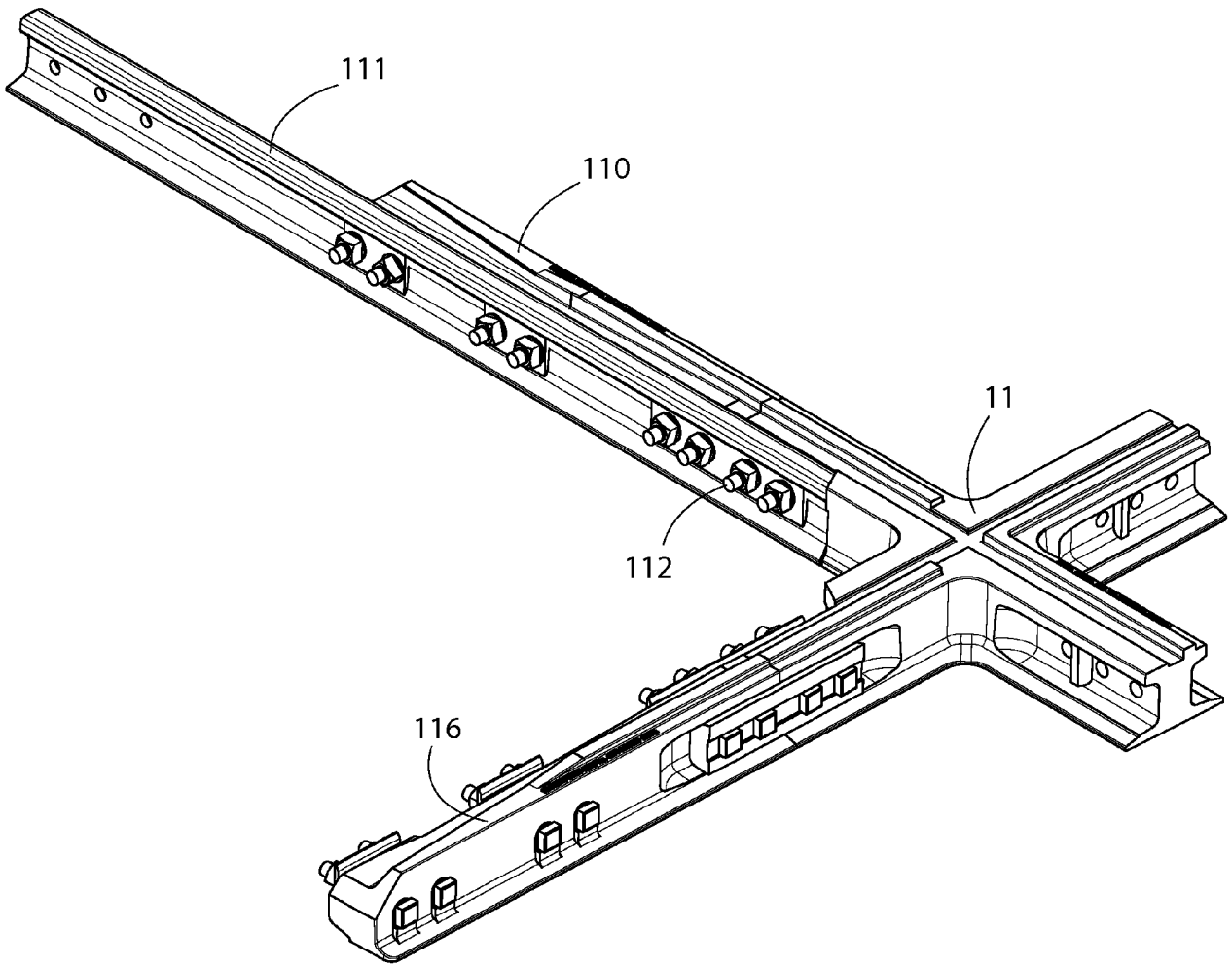
FIG. 26 is yet another upper perspective view of an assembly of an end full flange bearing casting with extension portions and an associated rail, in accordance with one embodiment of the present invention.

FIGS. 24-26 show in greater detail the arrangement of a portion of a crossing panel frog arrangement as shown in FIG. 11, and showing in more detail a portion of the panel assembly comprising end full flange bearing casting 11, extension portion 110, bolts 112 and plate 113, and rail 111. Also shown in this view is extension portion 116 extending along direction D from end full flange bearing casting 11 along the main line path, and in position to accept a main line rail beside it in a manner similar to the way rail 111 is positioned and secured.

FIG. 24 shows a relatively high angle perspective view of an arrangement of a portion of the full flange bearing crossing arrangement in accordance with one embodiment of the present invention.

This Figure shows end full flange bearing casting 11 adjoined to extension casting 110 and extension casting 116 to form the extended flange ways. The extension castings may be affixed and held in place by plates and bolts in accordance with rail or casting joining arrangements that may be appreciated by one of ordinary skill in the art.

This Figure further shows extension casting 116 as it would appear without a rail disposed alongside, and extension casting 110 as it would appear with a rail 111 disposed alongside so as to close the open side of the flange way as it courses through both a portion of the end full flange bearing casting 11 and the extension casting 110.

FIG. 25 shows an arrangement of a portion of the full flange bearing crossing arrangement in accordance with one embodiment of the present invention. This Figure shows end full flange bearing casting 11 adjoined to extension casting 110 and extension casting 116 to form the extended flange ways. The extension castings may be affixed and held in place by plates and bolts in accordance with rail or casting joining arrangements that may be appreciated by one of ordinary skill in the art.

From FIG. 25 it will also be appreciated that, in the preferred embodiment, the major portion of the open-sided part of the flange way resides in the extension casting 110 as compared to that portion of the open-sided part of the flange way resides in the end full flange bearing casting 11, wherein the ration of the major portion major portion to the minor portion typically is in the range of from about 10:1 to about 2:1, with the ratio of about 4:1 being preferred.

The overall length of the flange way (and that of the intersection and extension portions where used) full flange bearing casting will be determined by the application parameters, such as load and speed, and the desired rate of incline and decline for the crossing. Other considerations include convenient transport and handling of the constituent parts. As can be appreciated, the described embodiment allows for the convenient on-site assembly, as well as for on-site repair, replacement and/or repositioning of the crossing assembly as required or desired.

FIG. 26 shows a relatively low perspective view of the same portion of that arrangement, taken from an opposite side of the intersection point, and wherein like reference numerals are used to refer to portions thereof described herein.

Figure 27:
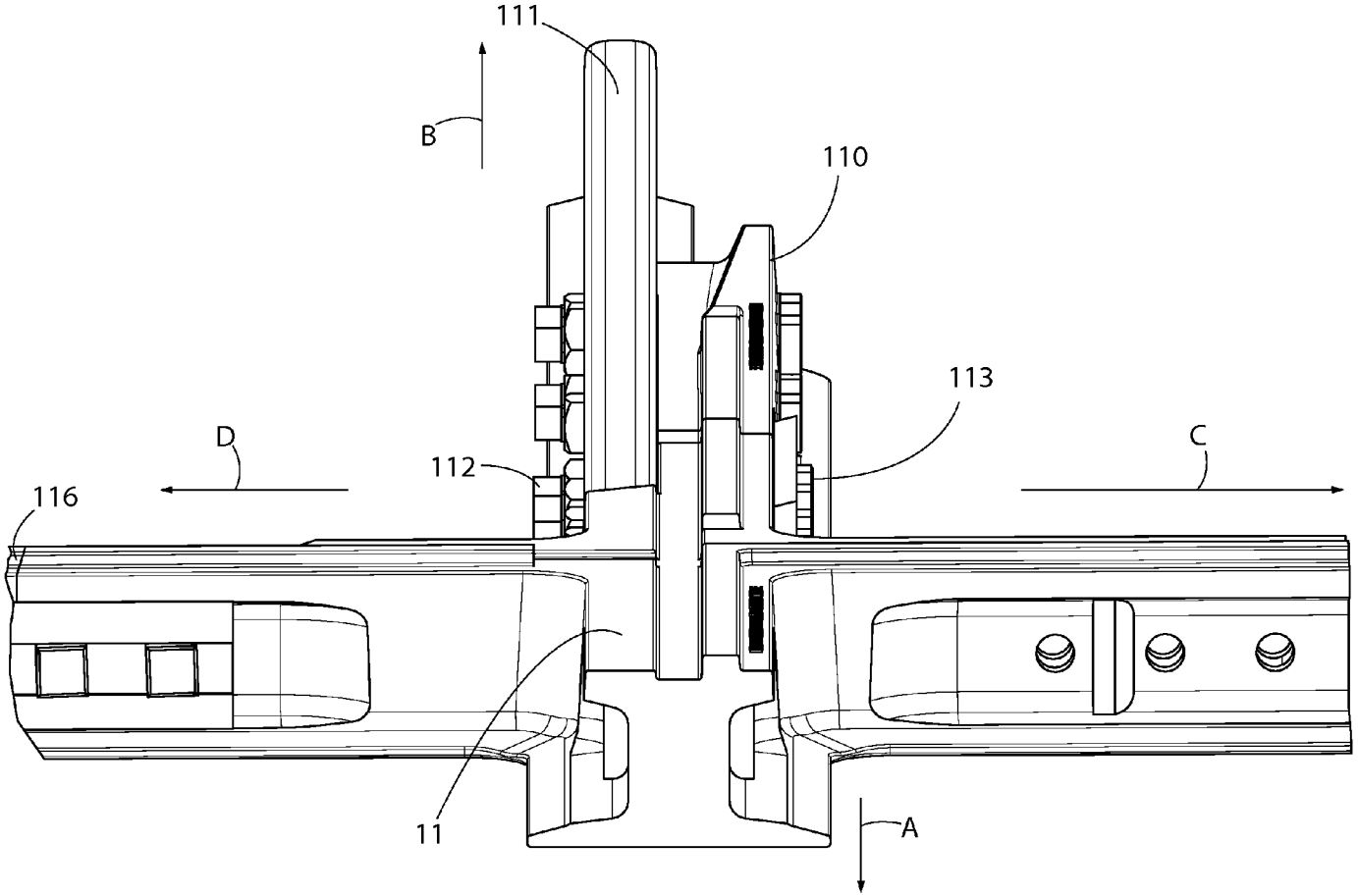
FIG. 27 is still another upper perspective view of an assembly of an end full flange bearing casting with extension portions and an associated rail, in accordance with one embodiment of the present invention.

FIG. 27 shows a relatively low perspective view, taken along the line of one of the flange ways, of an arrangement of a portion of the full flange bearing crossing arrangement in accordance with one embodiment of the present invention, and wherein like reference numerals are used to refer to portions thereof described herein.

Figure 28:
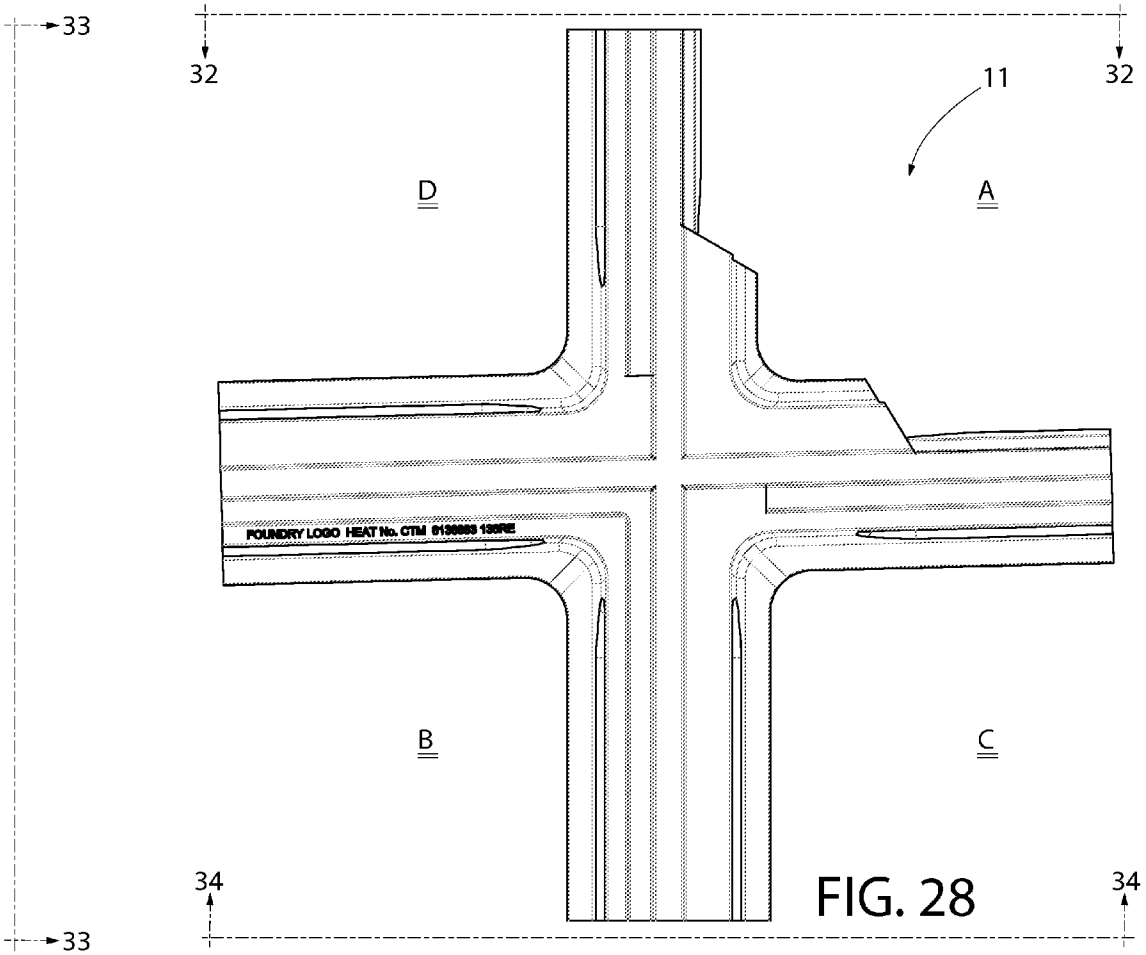
FIG. 28 is a top plan view of an end full flange bearing casting used in accordance with one embodiment of the assembly of the present invention.

FIG. 28 is a top plan view of an end full flange bearing casting 11 used in accordance with one embodiment of the assembly of the present invention.

Figure 29:
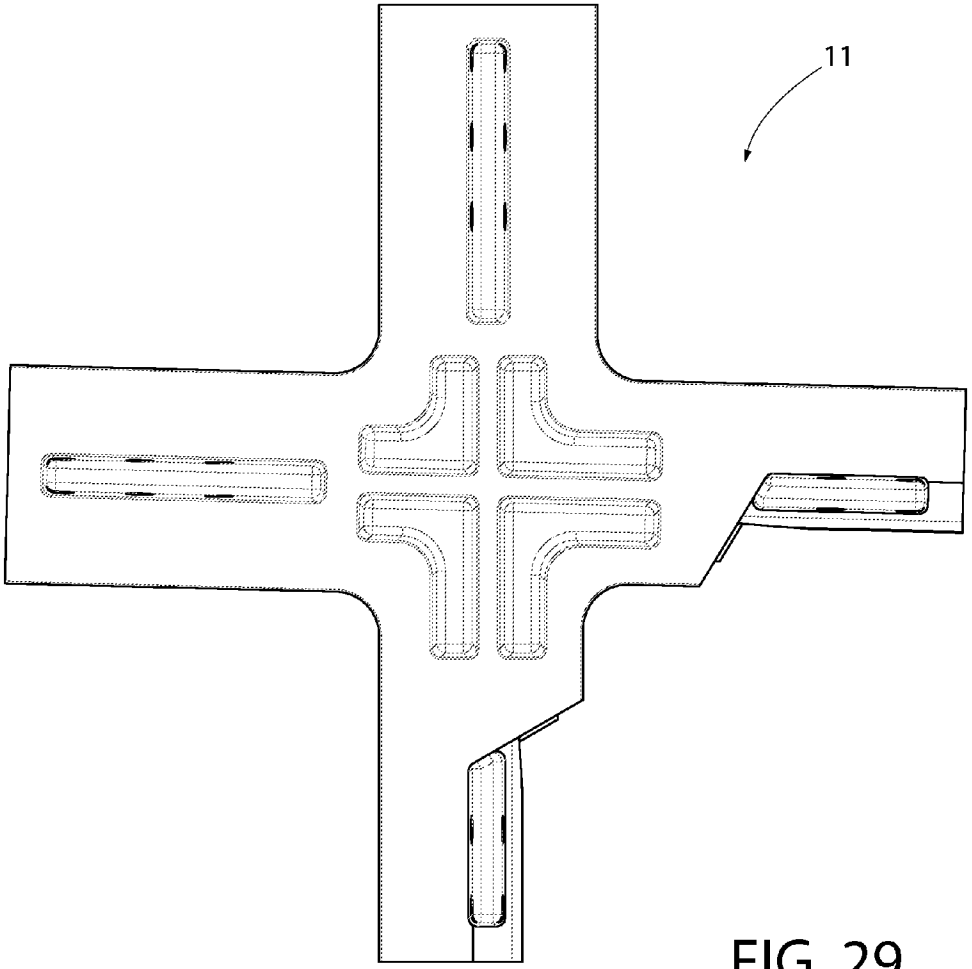
FIG. 29 is a bottom plan view of an end full flange bearing casting used in accordance with one embodiment of the assembly of the present invention.

FIG. 29 is a bottom plan view of an end full flange bearing casting 11 used in accordance with one embodiment of the assembly of the present invention.

Figure 30:
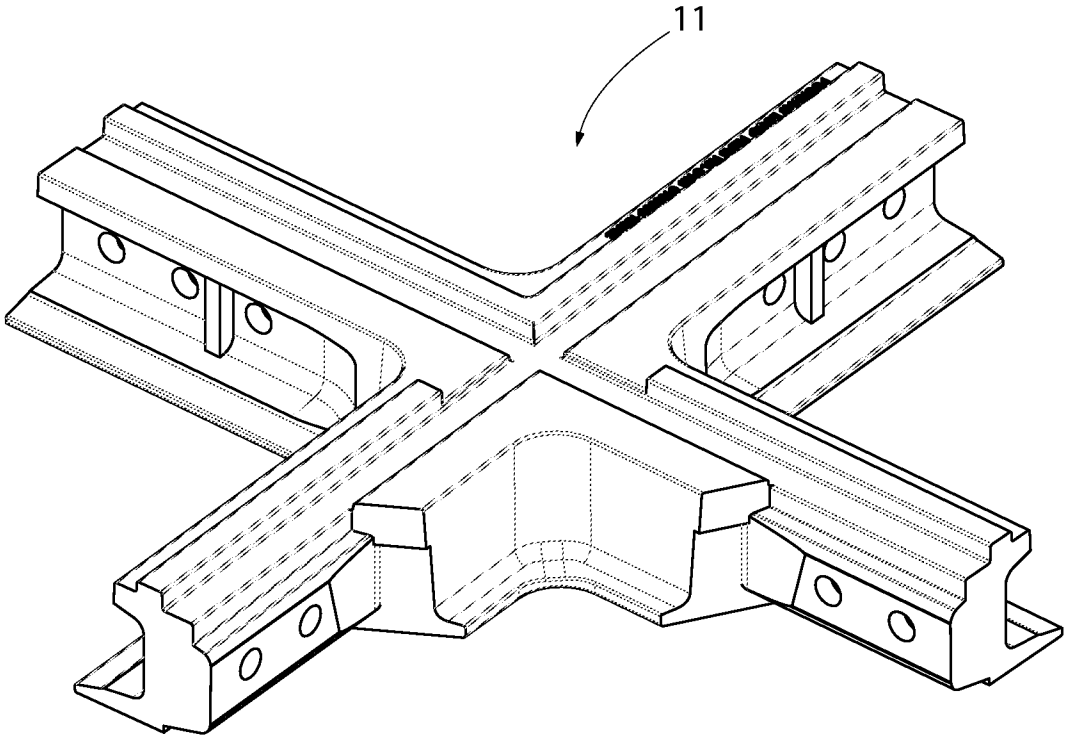
FIG. 30 is a first upper perspective view of an end full flange bearing casting used in accordance with one embodiment of the assembly of the present invention.

FIG. 30 is a first upper perspective view of an end full flange bearing casting 11 used in accordance with one embodiment of the assembly of the present invention, taken from quadrant A of FIG. 28.

Figure 31:
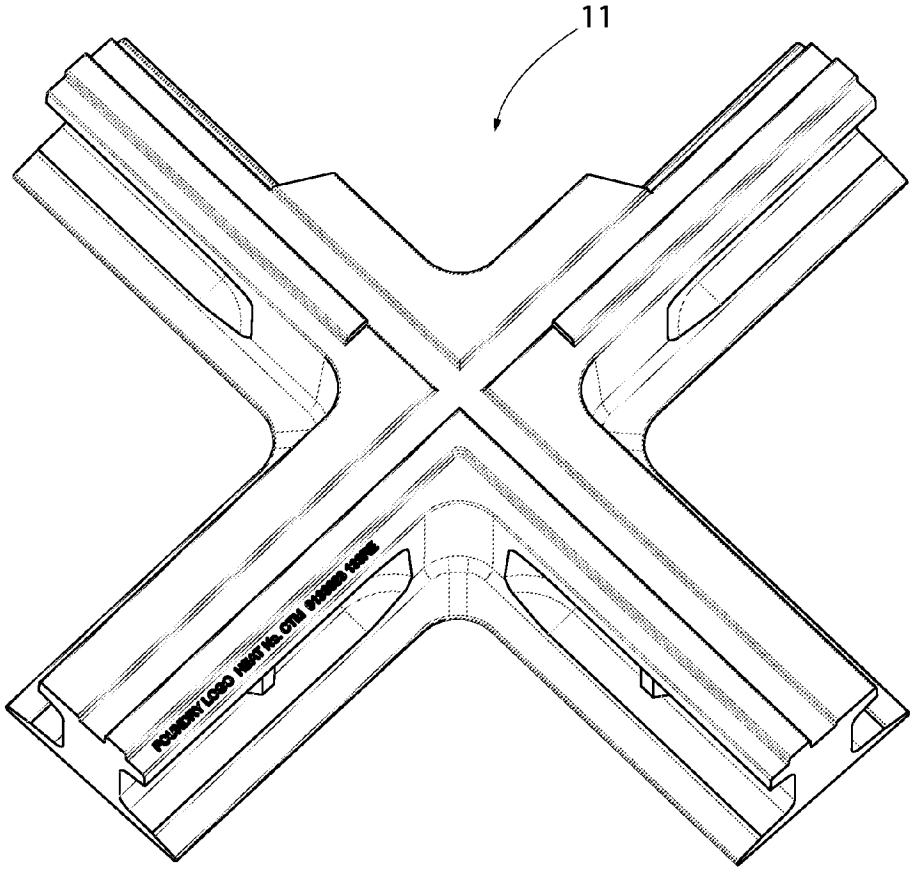
FIG. 31 is a second upper perspective view of an end full flange bearing casting used in accordance with one embodiment of the assembly of the present invention.

FIG. 31 is a second upper perspective view of an end full flange bearing casting 11 used in accordance with one embodiment of the assembly of the present invention, taken from quadrant B of FIG. 28.

Figure 32:
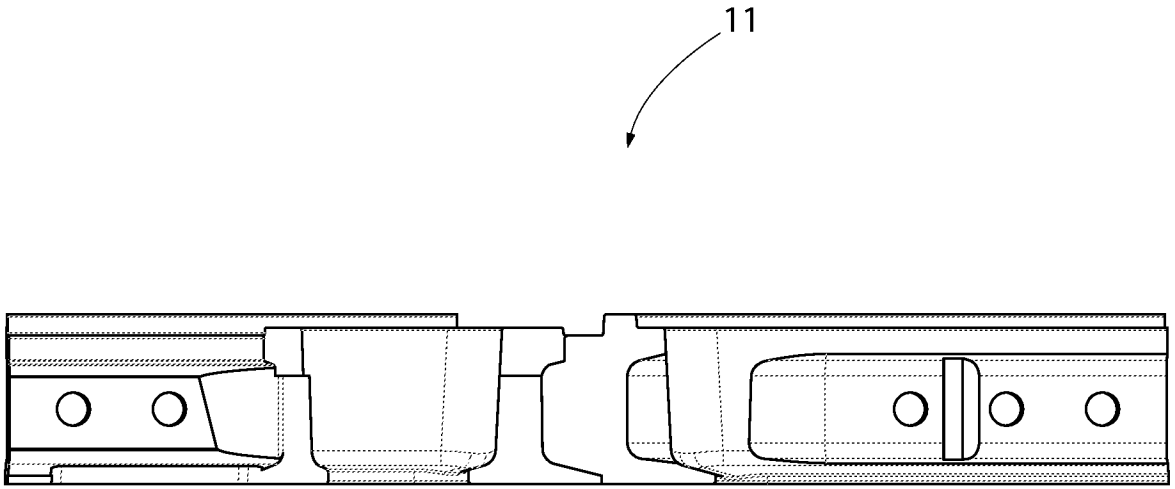
FIG. 32 is a first side elevation view of an end full flange bearing casting used in accordance with one embodiment of the assembly of the present invention.

FIG. 32 is a first side elevation view of an end full flange bearing casting 11 used in accordance with one embodiment of the assembly of the present invention, taken along line 32-32 of FIG. 28.

Figure 33:
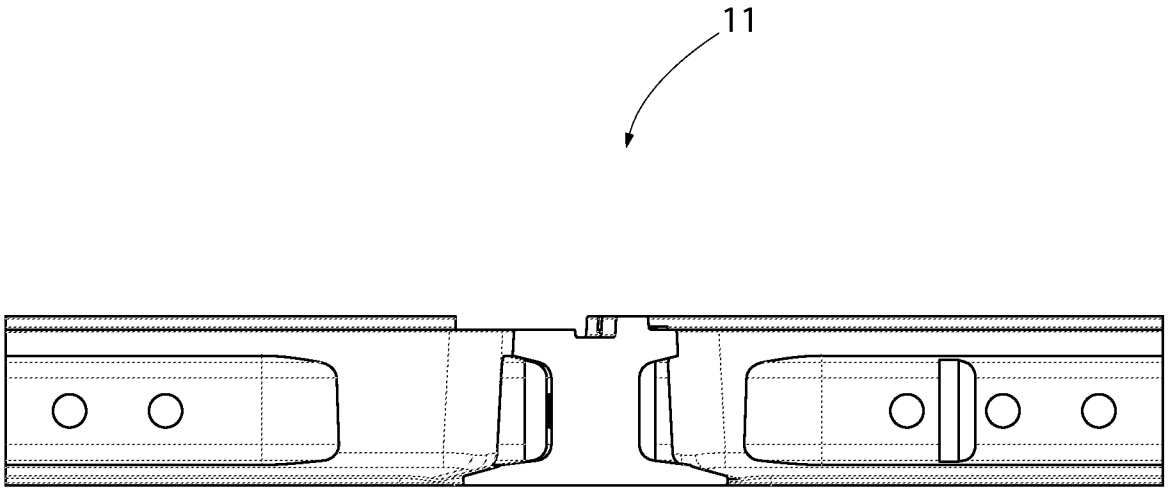
FIG. 33 is a second side elevation view of an end full flange bearing casting used in accordance with one embodiment of the assembly of the present invention.

FIG. 33 is a second side elevation view of an end full flange bearing casting 11 used in accordance with one embodiment of the assembly of the present invention, taken along line 33-33 of FIG. 28.

Figure 34:
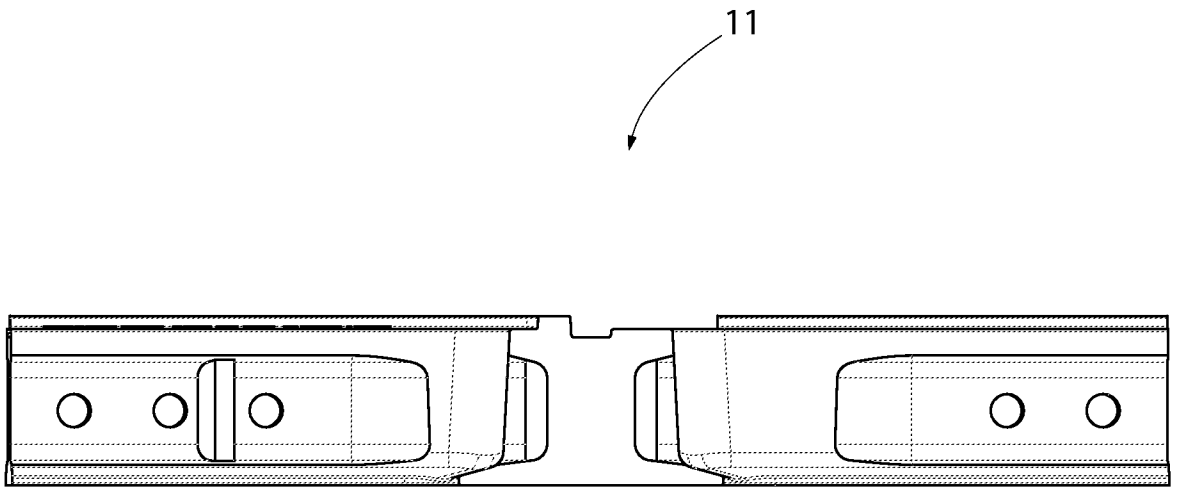
FIG. 34 is a third side elevation view of an end full flange bearing casting used in accordance with one embodiment of the assembly of the present invention.

FIG. 34 is a third side elevation view of an end full flange bearing casting 11 used in accordance with one embodiment of the assembly of the present invention, taken along line 34-34 of FIG. 28.

Figure 35:
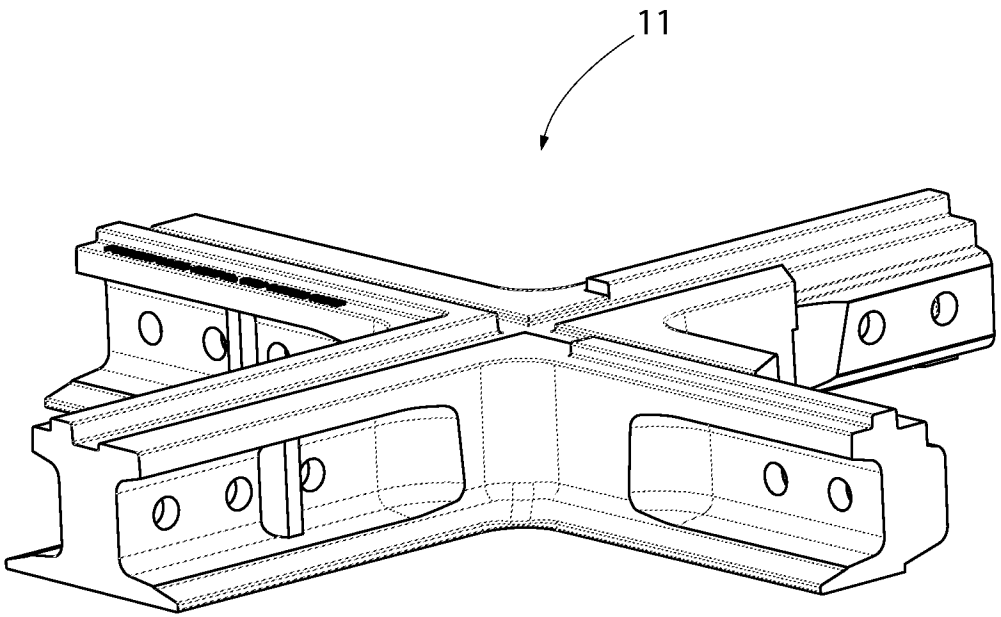
FIG. 35 is a third upper perspective view of an end full flange bearing casting used in accordance with one embodiment of the assembly of the present invention.

FIG. 35 is a third upper perspective view of an end full flange bearing casting 11 used in accordance with one embodiment of the assembly of the present invention, taken from quadrant C of FIG. 28.

Figure 36:
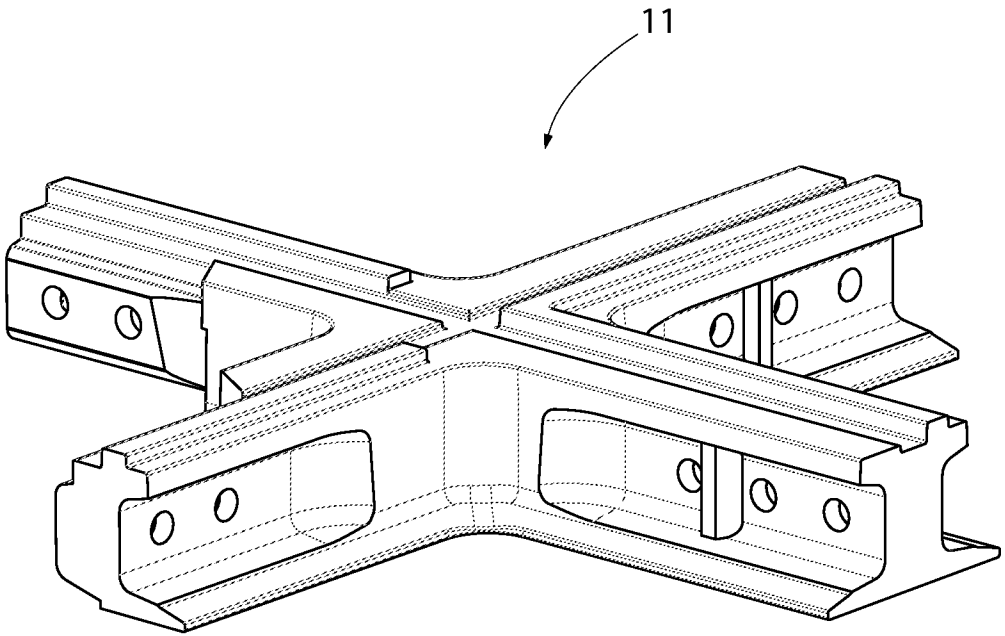
FIG. 36 is a fourth upper perspective view of an end full flange bearing casting used in accordance with one embodiment of the assembly of the present invention.

FIG. 36 is a fourth upper perspective view of an end full flange bearing casting 11 used in accordance with one embodiment of the assembly of the present invention, taken from quadrant D of FIG. 28.

Figure 37:
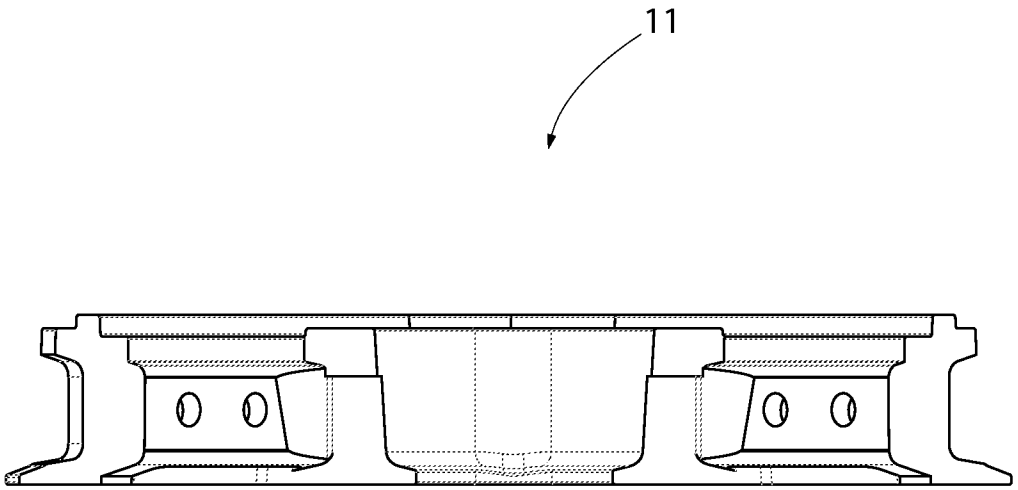
FIG. 37 is a fourth side elevation view of an end full flange bearing casting used in accordance with one embodiment of the assembly of the present invention.

FIG. 37 is a fourth side elevation view of an end full flange bearing casting 11 used in accordance with one embodiment of the assembly of the present invention, taken from quadrant A of FIG. 28.

Figure 38:
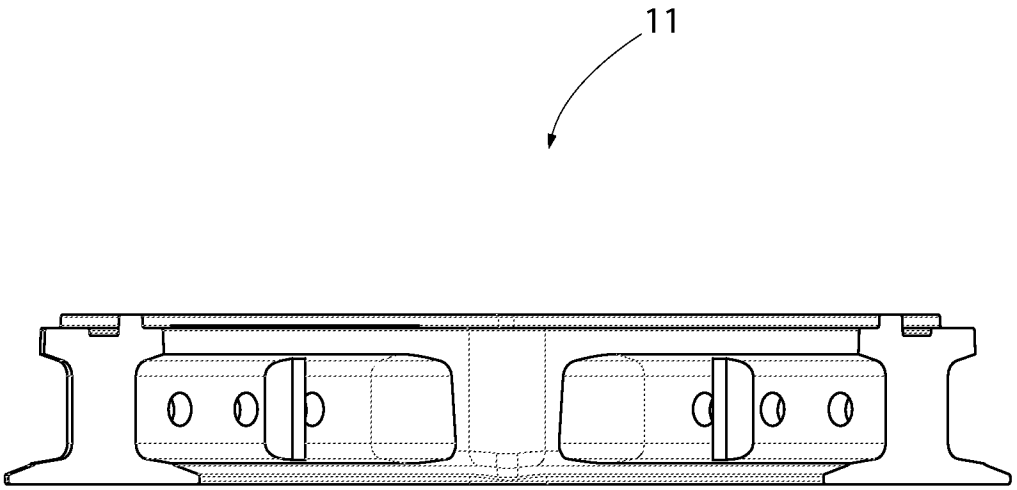
FIG. 38 is a fourth side elevation view of an end full flange bearing casting used in accordance with one embodiment of the assembly of the present invention.

FIG. 38 is a fourth side elevation view of an end full flange bearing casting 11 used in accordance with one embodiment of the assembly of the present invention, taken from quadrant B of FIG. 28.

Figure 39:
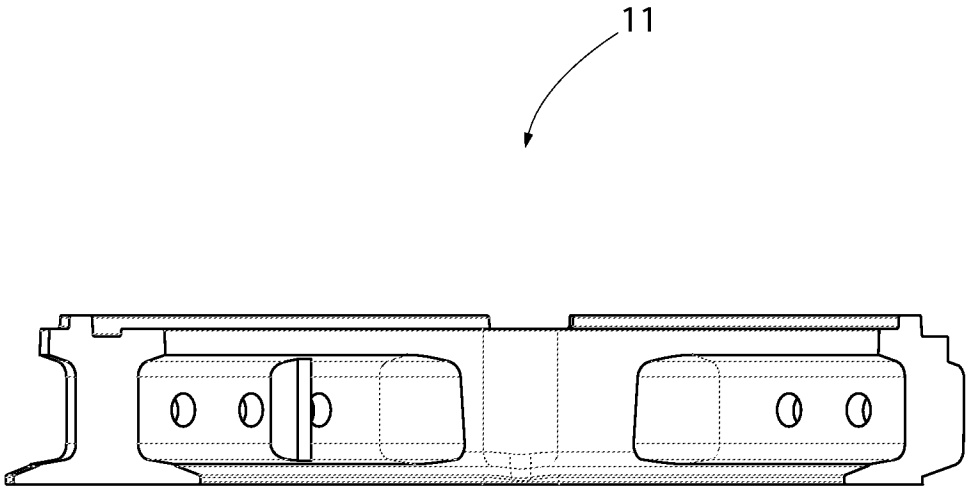
FIG. 39 is a fourth side elevation view of an end full flange bearing casting used in accordance with one embodiment of the assembly of the present invention.

FIG. 39 is a fourth side elevation view of an end full flange bearing casting 11 used in accordance with one embodiment of the assembly of the present invention, taken from quadrant C of FIG. 28.

Figure 40:
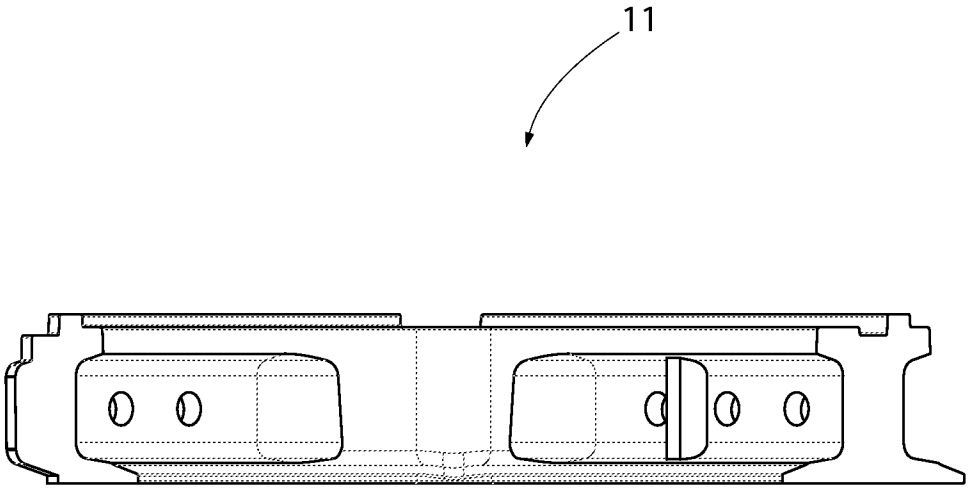
FIG. 40 is a fourth side elevation view of an end full flange bearing casting used in accordance with one embodiment of the assembly of the present invention.

FIG. 40 is a fourth side elevation view of an end full flange bearing casting 11 used in accordance with one embodiment of the assembly of the present invention, taken from quadrant D of FIG. 28.

Figure 41:
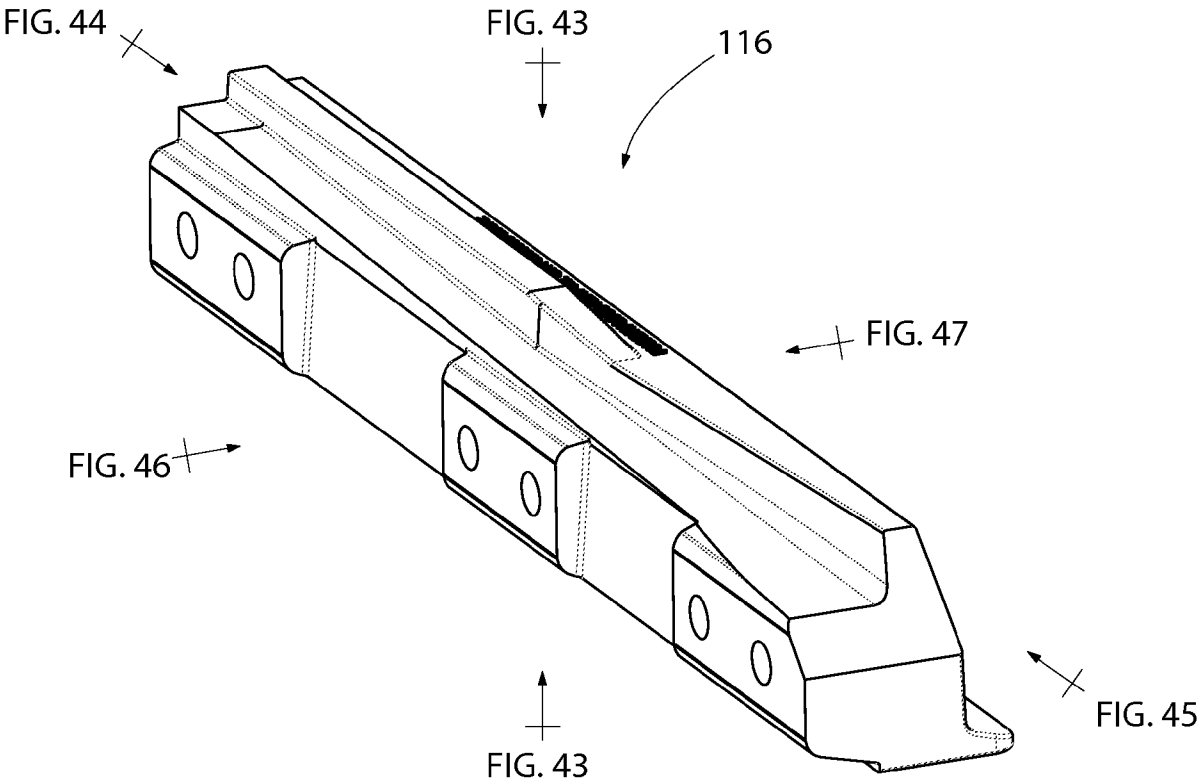
FIG. 41 is an upper perspective view of an extension portion casting used in accordance with one embodiment of the assembly of the present invention.

FIG. 41 is an upper entrance end perspective view of an extension portion casting 116 used in accordance with one embodiment of the assembly of the present invention.

Figure 42:
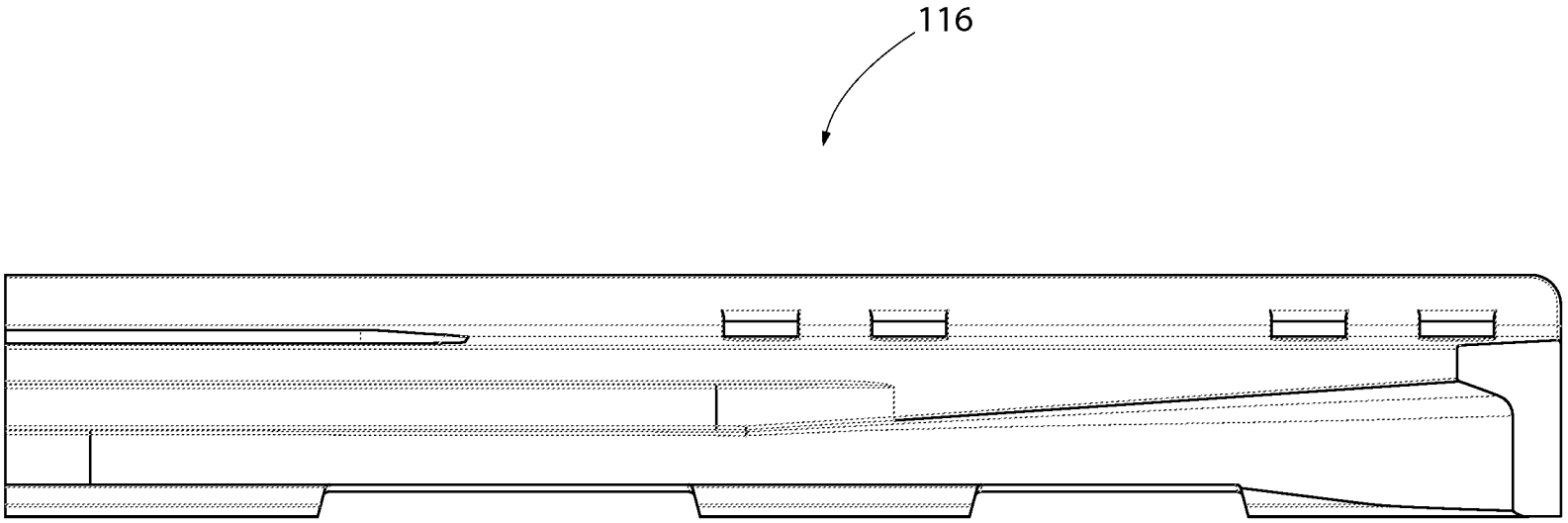
FIG. 42 is a top plan view of an extension portion casting used in accordance with one embodiment of the assembly of the present invention.

FIG. 42 is a top plan view of an extension portion casting 116 used in accordance with one embodiment of the assembly of the present invention, taken along direction line 42 of FIG. 41.

Figure 43:
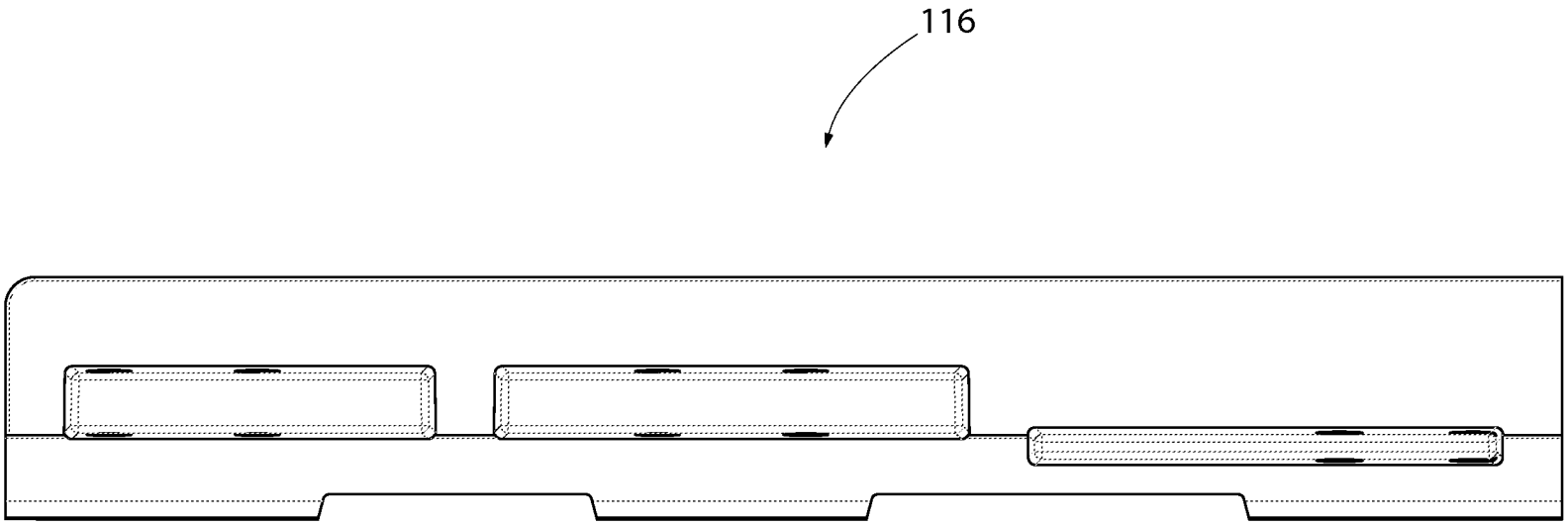
FIG. 43 is a bottom plan view of an extension portion casting used in accordance with one embodiment of the assembly of the present invention.

FIG. 43 is a bottom plan view of an extension portion casting 116 used in accordance with one embodiment of the assembly of the present invention, taken along direction line 43 of FIG. 41.

Figure 44:
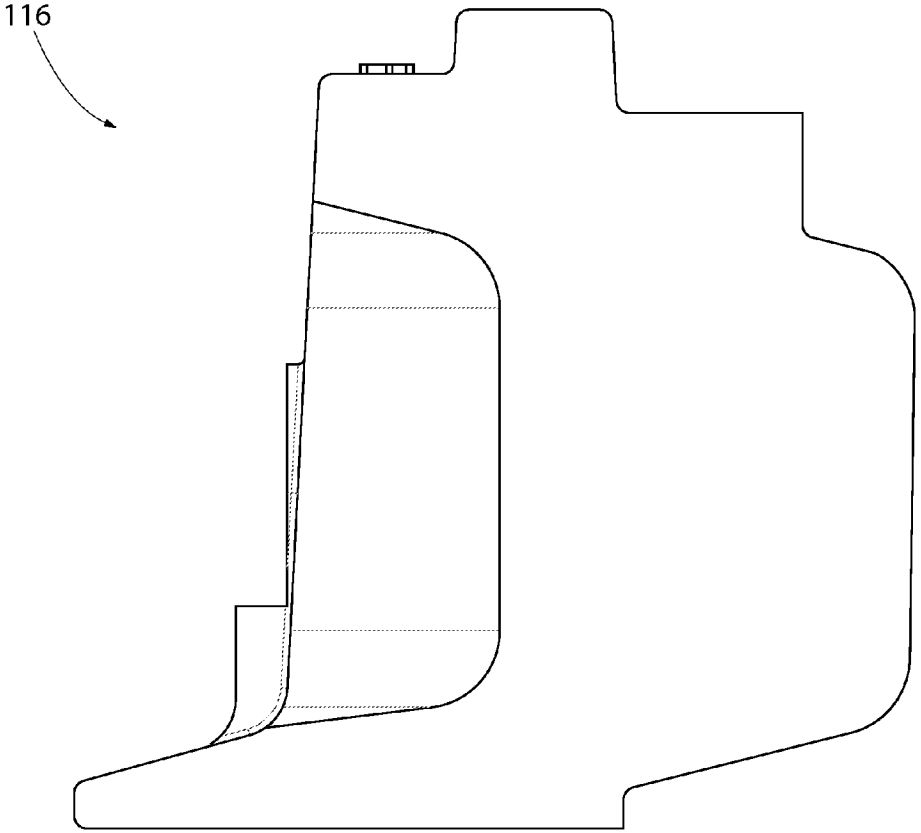
FIG. 44 is a first side elevation view of an extension portion casting used in accordance with one embodiment of the assembly of the present invention.

FIG. 44 is a first side elevation view of an extension portion casting 116 used in accordance with one embodiment of the assembly of the present invention, taken along direction line 44 of FIG. 41.

Figure 45:
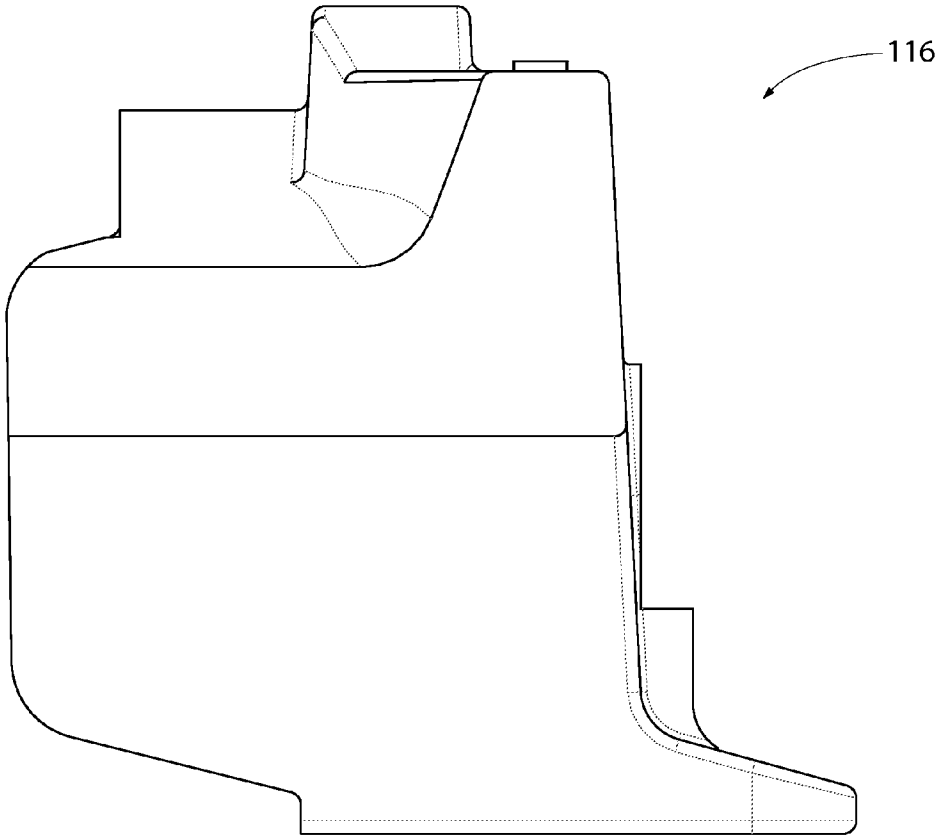
FIG. 45 is a second side elevation view of an extension portion casting used in accordance with one embodiment of the assembly of the present invention.

FIG. 45 is a second side elevation view of an extension portion casting 116 used in accordance with one embodiment of the assembly of the present invention, taken along direction line 45 of FIG. 41.

Figure 46:
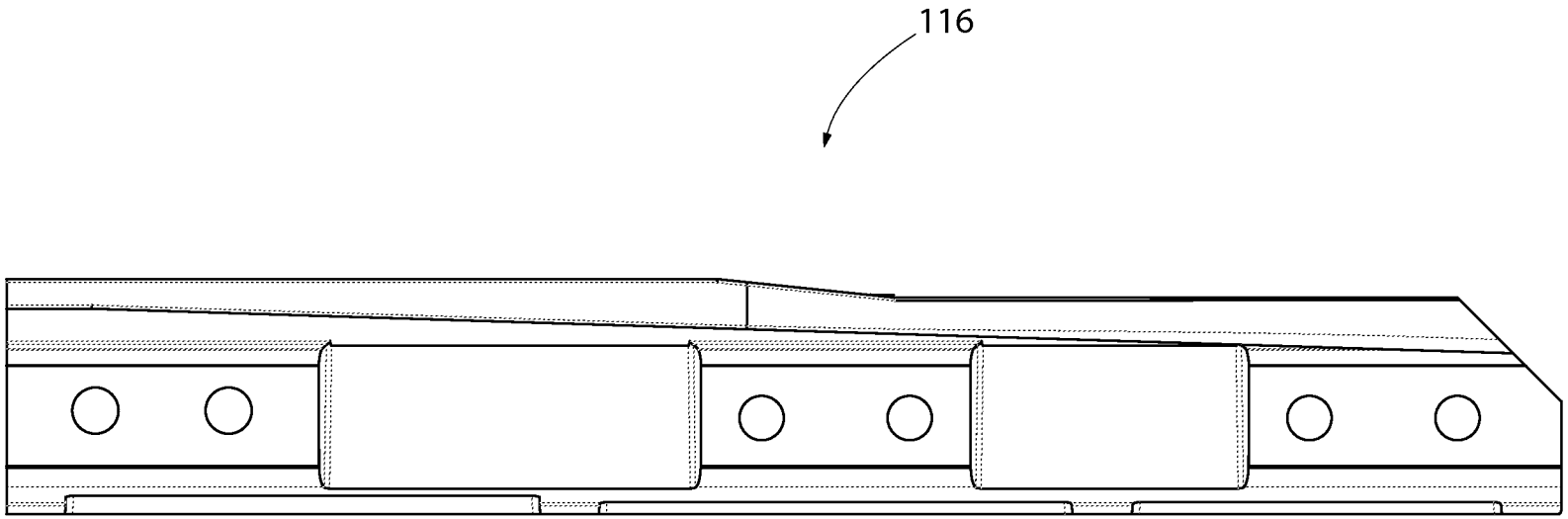
FIG. 46 is a third side elevation view of an extension portion casting used in accordance with one embodiment of the assembly of the present invention.

FIG. 46 is a third side elevation view of an extension portion casting 116 used in accordance with one embodiment of the assembly of the present invention, taken along direction line 46 of FIG. 41.

Figure 47:
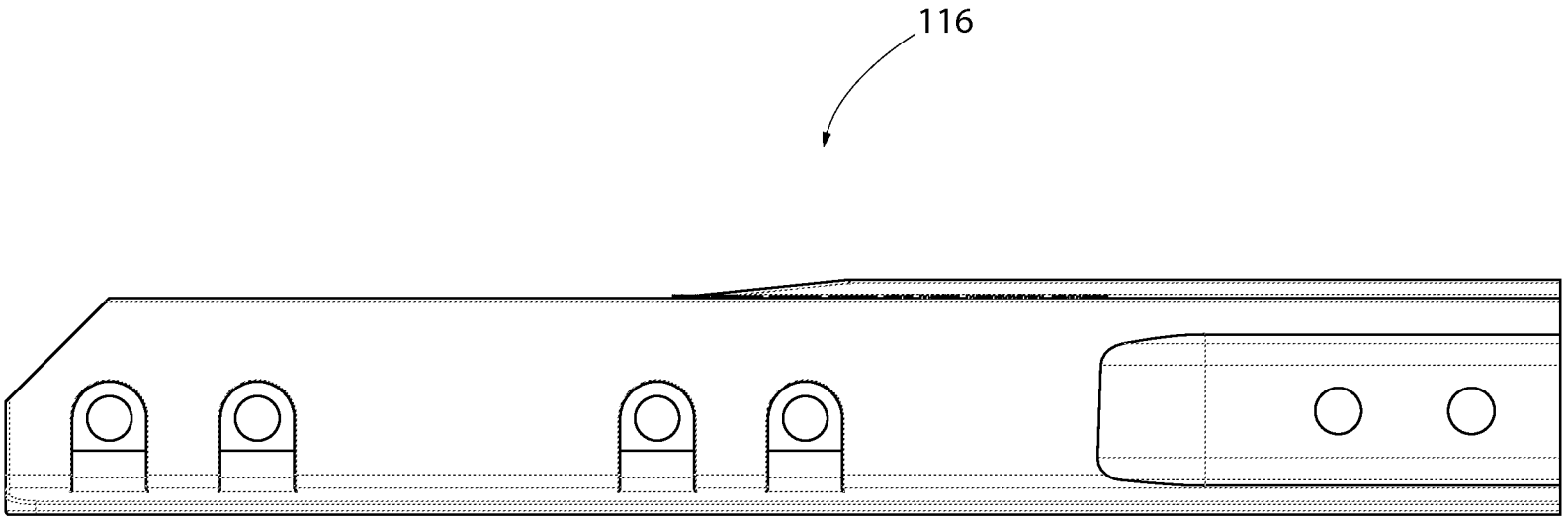
FIG. 47 is a fourth side elevation view of an extension portion casting used in accordance with one embodiment of the assembly of the present invention.

FIG. 47 is a fourth side elevation view of an extension portion casting 116 used in accordance with one embodiment of the assembly of the present invention, taken along direction line 47 of FIG. 41.

As to the crossing specifications, the following parts, specifications and parameters are preferred:

CROSSING ANGLE: 88 Deg 34 Min 00 Sec

TYPE OF CROSSING: Full Flange Bearing for 10 mph similar to Solid Manganese Steel, AREMA plan 771-02. Flangeways to be ¼" deep at intersection. Use 1" raised guards, taper rail joints on exterior arms, anti-creeper bars on internal joints. Explosive harden per ARMEA and CSX specifications.

TRACK ALIGNMENT: Tangent All Tracks. Track centers shown on drawing.

GAGE: 4' 8½"

RAIL: 136RE Head Hardened per CSX specification MW-99002A. Rail making up insulated joints must be matched (cut from the same piece).

FLANGEWAYS: AREMA standards ramped to ¼" deep at intersections for all tracks.

EXTERIOR ARM LENGTHS: As shown on drawing are approximate. All frog throats to be guarded. Guard rail flares and flange bearing ramps to be square to track. Manufacturer to supply all guard rails.

INSULATED JOINTS: Premium bonded L.B. Foster Kevlar (12 total) supported on Foster insulated plate with clips. Each joint is to have 5' 10" to 8' 6" blind end rail terminating in center of crib. Label length of signal dead section.

TIE LAYOUT: AREMA Plan 700F-01. Manufacturer to supply and pre-plate all ties for diamond. Include all ties where rail is located on both sides of track. Ties to be at least 10'-0" long. Double ties will be 10" tall and 12" wide and bolted together, remaining ties to be 10"×10". Double ties parallel to CSX route.

TIE PLATES: Large Base plates under castings to be 1½" thick with ½" milling and welded filler gage plates. Use track spikes against base of rail or casting perpendicular to grain. All holes to be round 1" diameter. Countersink holes not at rail base ½" deep. Milling to have 1/16" radius. Make surplus screw spike holes show major plate dimensions. Other plates to be 1½" thick milled seat gage plate with similar construction. Insulated joints shall use IJ manufacturer's plate with clip. Use a 1¼" milled seat insulated gage plate with Pandrol clips on the next plate beyond the insulated joint bars. Use individual plates with clips beyond that. Manufacturer to supply high strength rectangular head 6½" long screw spikes per Common Standard Drawing 130800. Pre-drill spike holes. All spike holes to be accessible when rail and castings are installed on plates. All plates are to be installed to ties at proper gage by manufacturer.

TIE PADS: Precut rubber pads, ¼" thick EDPM 3 ply 14 oz., nylon insert, to be located under all platework, and are commercially available from Cooper Enterprises 770-931-1141.

BODY BOLTS: All body bolts to be 1⅜" diameter SAE Grade 8 with 3/32" fillet radius, rolled threats, per SAE J429 specifications and traceable heat and lot numbers. Nuts to be North American standard heavy square fitted with head locks, security lock nuts, and hardened flat steel washers. Torque bolts to 2,200 (+200/−0) ft.-lbs., and lubricated unless bolts are to be field assembled. Provide two containers of anti-seize copper spray lubricant (commercially available from Bowman BD1097 20 oz cans) for bolting. Bolts not fully torqued shall be crated or boxed for shipping; use shop bolts with heads and nuts painted pink for temporary assemblies. All nuts must be accessible to a hydraulic torque wrench or have nut locks applied and torque head.

SPARE PARTS: Manufacturer to supply spare castings, and leg rails (one each type).

OTHER: Manufacturer to make site inspection prior to design. Manufacturer to ship as fully shop assembled and panelized, with bolts torqued, as shipping method will permit. Manufacturer to provide lifting weights for shipped assembles. Match mark assemblies for easy of assembly in the field. Manufacturer to provide annual report of diamond condition for the life of the diamond or 5 years maximum. Report to include digital photographs. Manufacturer to supply hydraulic torque wrench with intensifier (commercially available from Simplex PT-R3, CXS SCN 015.0001681.1, IRS) or equivalent.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

The following patent documents generally describe crossing, frog and rail systems with which the present invention may be used, and such references are hereby incorporated herein by reference:

| | |
|---|---|
| 7,377,471 | Method and system for opening and securing a railroad frog |
| 7,121,513 | Cross frog for a set of track points, provided with an end of position-retaining device |
| 7,083,149 | Cross frog |
| 6,994,299 | Railroad crossing apparatus having improved rail connection and improved flangeway floor geometry and method incorporating the same |
| 6,732,980 | Railway frog wear component |
| 6,543,728 | Cross frog |
| 6,340,140 | Railroad frog for switch points and crossings |
| 6,286,791 | Railroad spring wing frog with hold-open and shock dampening elements |
| 6,276,642 | Railroad spring wing frog assembly |
| 6,266,866 | Frog insert and assembly and method for making frog assembly |
| 6,224,023 | Railroad spring frog assembly |
| 6,177,205 | Process for producing a permanent way component and such a component |
| 6,164,602 | Railroad frog assembly with multi-position holdback |
| 6,158,697 | Railroad frog assembly with latch holdback |
| 6,138,958 | Spring rail frog |
| 5,810,298 | Railroad spring frog assembly |
| 5,806,810 | Spring rail frog having switchable magnet for holding wing rail open |
| 5,782,437 | Spring rail frog having bendable rail with modified cross-section |
| 5,743,496 | Railroad frog crossing bolt and nut assembly for clamping railroad rail sections together |
| 5,598,993 | Pseudo heavy point frog assembly |
| 5,595,361 | Wing rail hold-down |
| 5,560,571 | Reversible wing insert frog |
| 5,544,848 | Railroad spring frog |
| 5,531,409 | Flange bearing bolted rail frog for railroad turnouts and crossings |
| 5,522,570 | Rail section |

-continued

| | |
|---|---|
| 5,375,797 | Compound geometry rail switch |
| 5,184,791 | Frog tip that can be shifted relative to the wing rails |
| 5,082,214 | Crossing frog with a moving point |
| 5,042,755 | Process for producing a crossing frog with a moving point |
| 4,982,919 | Reversing device for movable parts of a railway switch |
| 4,953,814 | Railway switch comprising a frog having a movable main point and auxiliary point |
| 4,948,073 | Turnout with closing frog |
| 4,908,993 | Grinding machine for reprofiling railheads |
| 4,756,477 | Plate for supporting railway rails and a track assembly using it |
| 4,637,578 | Railroad frog having movable wing rails |
| 4,624,428 | Spring rail frog |
| 4,589,617 | Frog for switches |
| 4,516,504 | Cross-over track structure for wheeled pallets |
| 4,514,235 | Frog, in particular frog point, for rail crossing or rail switches as well as process for producing same |
| 4,469,299 | Railway turnouts |
| 4,169,745 | Method of joining frogs of wear-resisting manganese steel castings to rails of carbon steel |
| 4,168,817 | Rail switch |
| 4,159,090 | Railway switch for vignoles rails |
| 4,144,442 | Process for producing a component part of a railway switch or a railway crossing and component part of railway switches or railway crossings produced by such process |
| 4,015,805 | Railway switch or railway crossing |
| 20,100,270,436 | ADJUSTMENT DEVICE IN RAILROAD SWITCHES |
| 20,070,007,394 | System, method, and apparatus for railroad turnout and derail lift frog |
| 20,060,202,047 | Use of k-spiral, bend, jog, and wiggle shapes in design of railroad track turnouts and crossovers |
| 20,050,145,754 | Cross frog |
| 20,050,067,535 | Cross frog for a set of track points, provided with an end of position-retaining device |
| 20,040,124,316 | Railroad crossing apparatus having improved rail connection and improved flangeway floor geometry and method incorporating the same |
| 20,040,065,784 | Railway frog wear component |

What is claimed is:

1. A full flange bearing rail crossing frog and rail arrangement comprising:

a. a frog casting comprising:

i. a main line body portion having a top surface and comprising a main line flange way having:

1. a main line flange way floor, and 2. opposed main line flange way lateral wall portions;

ii. a crossing line body portion having a top surface and comprising a crossing line flange way having:

1. an intersection portion of the crossing line flange way having:

a. a crossing line flange way floor b. a crossing line internal lateral wall portion; and c. a crossing line external lateral wall portion; and 2. a lead portion of the crossing line flange way having:

a. a crossing line flange way floor;

b. a crossing line internal lateral wall portion; and c. an open crossing line external lateral side;

the main line flange way and the crossing line flange way forming an intersection at an intersection level; and b. a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface.

2. A full flange bearing rail crossing frog and rail arrangement according to claim 1 wherein the frog casting comprises a first section comprising the main line body portion and the intersection portion of the crossing line flange way, and a second section comprising the lead portion of the crossing line flange way.

3. A full flange bearing rail crossing frog and rail arrangement according to claim 1 wherein the crossing line flange way floor of the lead portion of the crossing line flange way is angled so as to raise the flange of a rail car wheel rolling therethrough from a lower level to a higher level of that of the intersection portion of crossing line flange way.

4. A full flange bearing rail crossing frog and rail arrangement comprising:

a. a frog casting comprising:

i. a main line body portion having a top surface and comprising a main line flange way having a main line flange way floor and opposed main line flange way lateral wall portions; and ii. a crossing line body portion having a top surface and comprising a crossing line flange way, the crossing line flange way comprising:

1. a crossing line flange way floor and
2. a crossing line internal lateral wall portion; and
3. an open crossing line external lateral side;

the main line flange way and the crossing line flange way forming an intersection at an intersection level; and b. a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface.

5. A full flange bearing rail crossing frog and rail arrangement according to claim 1 wherein the crossing rail has a terminal end abutting the crossing line tread bearing portion at an angle in the range of from about 50 degrees to about 70 degrees from the crossing line flange way floor.

6. A full flange bearing rail crossing frog and rail arrangement according to claim 1 wherein the crossing line flange way floor has an inclined portion adapted to raise the flange of a wheel approaching the frog casting from the crossing rail to the intersection level.

7. A full flange bearing rail crossing frog and rail arrangement comprising:

a. a frog casting comprising:

i. a main line body portion having a main line top surface and a main line flange way, the main line flange way comprising:

1. a main line flange way floor and
2. a main line internal lateral wall portion; and
3. a main line open external lateral side; and ii. a crossing line body portion having a crossing line top surface and a crossing line flange way, the crossing line flange way comprising:

1. a crossing line flange way floor and
2. a crossing line internal lateral wall portion; and
3. a crossing line open external lateral side;

the main line flange way floor and the crossing line flange way floor forming an intersection at an intersection level; and b. a crossing rail having a crossing rail tread bearing surface, the crossing rail disposed along the open crossing line external lateral side, and adjacent the crossing line body portion top surface, such that the crossing rail tread bearing surface is vertically aligned with the crossing line body portion top surface; and c. a main rail having a main rail tread bearing surface, the main rail disposed along the open main line external lateral side, and adjacent the main line body portion top surface, such that the main rail tread bearing surface is vertically aligned with the main line body portion top surface.

8. A full flange bearing rail crossing frog and rail arrangement according to claim 7 wherein the crossing rail has a terminal end abutting the crossing line tread bearing portion at an angle in the range of from about 50 degrees to about 70 degrees from the crossing line flange way floor.

9. A full flange bearing rail crossing frog and rail arrangement according to claim 7 wherein the main rail has a terminal end abutting the main line tread bearing portion at an angle in the range of from about 50 degrees to about 70 degrees from the main line flange way floor.

10. A full flange bearing rail crossing frog and rail arrangement according to claim 7 wherein the crossing line flange way floor has an inclined portion adapted to raise the flange of a wheel approaching the frog casting from the crossing rail to the intersection level.

11. A full flange bearing rail crossing frog and rail arrangement according to claim 7 wherein the main line flange way floor has an inclined portion adapted to raise the flange of a wheel approaching the frog casting from the main rail to the intersection level.

* * * * *